US007051489B1

(12) United States Patent
Swiszcz et al.

(10) Patent No.: US 7,051,489 B1
(45) Date of Patent: May 30, 2006

(54) CEILING SYSTEM WITH REPLACEMENT PANELS

(75) Inventors: Paul G. Swiszcz, Boulder, CO (US); Ko Kuperus, Boulder, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 323 days.

(21) Appl. No.: 09/719,899

(22) PCT Filed: Aug. 4, 2000

(86) PCT No.: PCT/US00/21343

§ 371 (c)(1),
(2), (4) Date: Aug. 5, 2002

(87) PCT Pub. No.: WO01/12911

PCT Pub. Date: Feb. 22, 2001

Related U.S. Application Data

(60) Provisional application No. 60/148,834, filed on Aug. 12, 1999.

(51) Int. Cl.
*E04C 2/32* (2006.01)

(52) U.S. Cl. ..... 52/783.18; 52/793.1; 52/646; 160/84.05; 428/116; 428/119; 428/73

(58) Field of Classification Search ..... 52/783.11, 52/783.17, 783.18, 783.19, 645, 646, 202, 52/796.1, 309.8, 793.1; 428/72, 86, 101, 428/116, 119, 120, 188, 223, 304.4, 304.9, 428/73; 160/84.05
See application file for complete search history.

(56) References Cited

U.S. PATENT DOCUMENTS

| | | | | |
|---|---|---|---|---|
| 2,220,596 A | | 11/1940 | Bernhardt | 20/91 |
| 2,333,343 A | | 11/1943 | Sendzimir | |
| 2,419,971 A | | 5/1947 | Rumpf et al. | |
| 2,779,851 A | | 1/1957 | Vogt | |
| 3,112,533 A | | 12/1963 | Hauer | 20/15 |
| 3,314,846 A | * | 4/1967 | Niwa | 428/12 |
| 3,413,765 A | | 12/1968 | Williams | |

(Continued)

FOREIGN PATENT DOCUMENTS

| | | | | |
|---|---|---|---|---|
| AU | A-80 566/82 | * | 8/1982 | 52/783.1 |

(Continued)

OTHER PUBLICATIONS

Gubenko, A.B., "Building Structures Wherein Plastics Are Used", Building Structures With the Use of Plastic Materials, Moscow, Publishing House for Literature on the Civil Engineering, pp. 35, 38, 39, and 46, (1970).

*Primary Examiner*—Naoko Slack
(74) *Attorney, Agent, or Firm*—Dorsey & Whitney LLP

(57) ABSTRACT

A panel for use in a drop ceiling system, or with appropriate modification, a wall, wherein the ceiling system includes stringers and cross-members defining areas therebetween for support of the panels wherein the panels include at least one planar sheet of material secured to a reinforcement member having channels formed therein to extend in at least one direction relative to the sheet material. When more than one sheet of material is used, the sheets of material are disposed on opposite sides of the reinforcement member. The panels are flexible for easy insertion into the openings between the stringers and cross-members of the support system and are readily compressed into a thinner profile for shipping purposes.

91 Claims, 28 Drawing Sheets

U.S. PATENT DOCUMENTS

| | | | | | |
|---|---|---|---|---|---|
| 3,432,379 | A | | 3/1969 | Anderson | 161/68 |
| 3,542,636 | A | | 11/1970 | Wandel | 161/114 |
| 3,689,345 | A | | 9/1972 | Figge | 156/219 |
| 3,741,859 | A | | 6/1973 | Wandel | 161/137 |
| 3,749,636 | A | | 7/1973 | Tranquillitsky | 161/37 |
| 3,762,977 | A | | 10/1973 | Langfeldt | |
| 3,819,465 | A | | 6/1974 | Parsons et al. | |
| 3,819,466 | A | | 6/1974 | Winfield et al. | |
| 4,020,205 | A | | 4/1977 | Haselbauer | 428/116 |
| 4,034,135 | A | | 7/1977 | Passmore | 428/184 |
| 4,221,373 | A | | 9/1980 | Hans | |
| 4,223,053 | A | | 9/1980 | Brogan | |
| 4,315,962 | A | * | 2/1982 | Skoien | 428/12 |
| 4,595,187 | A | | 6/1986 | Bober | |
| 4,672,780 | A | | 6/1987 | Lockwood | 52/82 |
| 4,840,828 | A | | 6/1989 | Bottger et al. | 428/120 |
| 4,852,316 | A | * | 8/1989 | Webb | 52/235 |
| 5,024,131 | A | | 6/1991 | Weidman | |
| 5,028,474 | A | | 7/1991 | Czaplicki | |
| 5,128,195 | A | | 7/1992 | Hegedus | |
| 5,182,158 | A | | 1/1993 | Schaeffer | |
| 5,240,533 | A | | 8/1993 | Bottger et al. | |
| 5,256,467 | A | | 10/1993 | Kato | |
| 5,270,095 | A | | 12/1993 | Ito et al. | |
| 5,424,113 | A | | 6/1995 | Ray et al. | |
| 5,543,204 | A | * | 8/1996 | Ray | 428/179 |
| 5,567,504 | A | | 10/1996 | Schakel et al. | |
| 5,670,220 | A | * | 9/1997 | Skoien | 428/12 |
| 5,685,124 | A | * | 11/1997 | Jandl, Jr. | 52/783.11 |
| 5,791,118 | A | * | 8/1998 | Jordan | 52/783.11 |
| 5,792,539 | A | * | 8/1998 | Hunter | 428/72 |
| 5,832,685 | A | * | 11/1998 | Hermanson | 52/506.07 |
| 5,840,413 | A | | 11/1998 | Kajander | |
| 5,942,288 | A | | 8/1999 | Kajander | |
| 5,972,434 | A | | 10/1999 | Kajander | |
| 6,067,764 | A | | 5/2000 | Johansen | |
| 6,079,172 | A | | 6/2000 | Chenel | |
| 6,080,495 | A | | 6/2000 | Wright | |
| 6,209,273 | B1 | | 4/2001 | Jeffers et al. | |
| 6,296,469 | B1 | | 10/2001 | Suzuki | |
| 6,656,858 | B1 | * | 12/2003 | Cahill | 442/370 |
| 6,712,747 | B1 | | 3/2004 | Ballard | |

FOREIGN PATENT DOCUMENTS

| | | | | |
|---|---|---|---|---|
| CA | 595285 | | 3/1958 | |
| CA | 920763 | | 2/1973 | |
| CH | 362824 | | 8/1962 | |
| CH | 383429 | | 1/1965 | |
| CH | 466538 | | 1/1969 | |
| DE | 525 253 | | 5/1931 | |
| DE | 684202 | | 11/1939 | |
| DE | 1 123 100 | | 2/1962 | |
| DE | 1941054 | | 6/1966 | |
| DE | 1 609 661 | | 5/1970 | |
| DE | 2 243 528 | | 3/1974 | |
| DE | 23 53 927 | | 5/1975 | |
| DE | 92 05 226.6 | | 9/1993 | |
| DE | 196 01 172 | | 1/1997 | |
| DE | 197 36 839 | | 2/1999 | |
| EP | 0 265 562 | | 5/1988 | |
| EP | 0 335 321 | | 10/1989 | |
| EP | 0 418 968 | | 3/1991 | |
| EP | 0 459 938 | | 12/1991 | |
| EP | 0 465 712 | | 1/1992 | |
| EP | 0 512 431 | | 12/1996 | |
| EP | 0 551 415 | | 1/1997 | |
| EP | 0 786 331 | | 7/1997 | |
| FI | 1252/48 | * | 5/1950 | 156/197 |
| FI | 23939 | | 5/1950 | |
| FR | 874.638 | | 8/1942 | |
| FR | 1.116.248 | | 5/1956 | |
| FR | 1294807 | | 4/1962 | |
| FR | 2.164.463 | | 8/1973 | |
| FR | 2 509 223 | | 1/1983 | |
| FR | 2.626.599 | | 8/1989 | |
| FR | 2 630 478 | | 10/1989 | |
| FR | 2727711 | | 6/1996 | |
| GB | 1 318 693 | | 5/1973 | |
| GB | 1 384 577 | | 2/1975 | |
| GB | 1481980 | | 8/1977 | |
| GB | 2050547 | | 1/1981 | |
| NL | 272341 | | 8/1964 | |
| NL | 7007693 | | 12/1970 | |
| NL | 7315664 | | 5/1974 | |
| NL | 7402604 | | 8/1974 | |
| SU | 102898 | | 3/1953 | |
| SU | 1822898 | | 6/1993 | |
| SU | 18229898 | | 6/1993 | |
| WO | WO 89/00897 | | 2/1989 | |
| WO | WO 90/12934 | | 11/1990 | |
| WO | WO 91/19866 | | 12/1991 | |
| WO | WO 97/11825 | | 4/1997 | |
| WO | WO 98/52744 | | 11/1998 | |

* cited by examiner

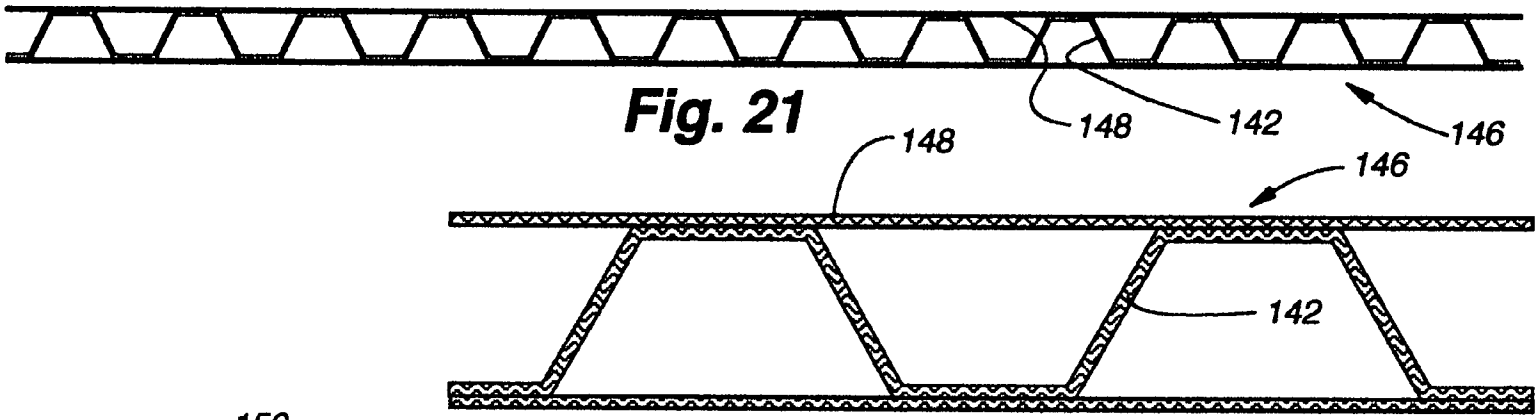
Fig. 21
Fig. 22
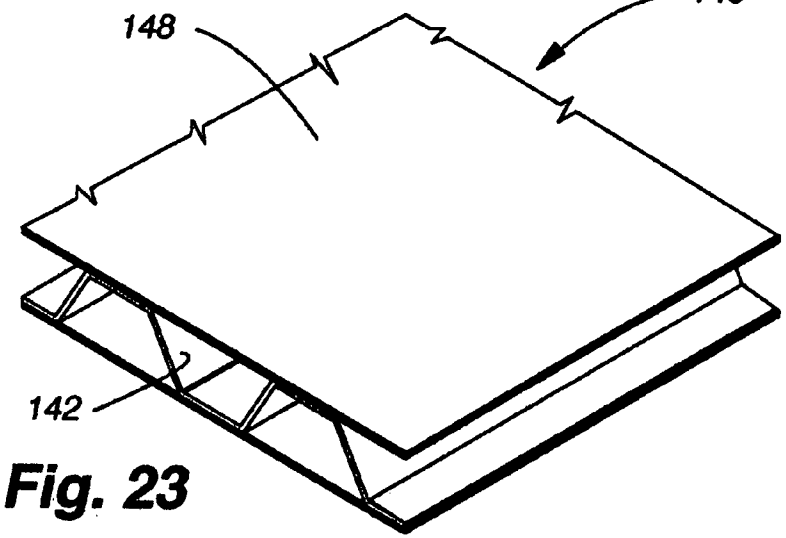
Fig. 23
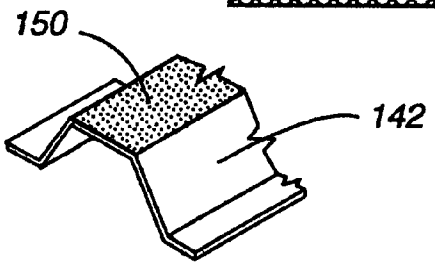
Fig. 24
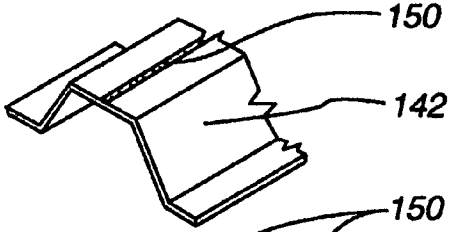
Fig. 25
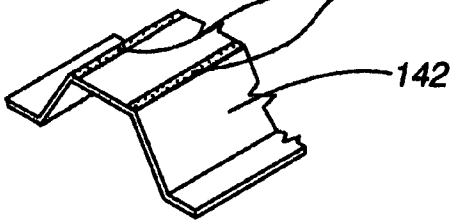
Fig. 26

CEILING SYSTEM WITH REPLACEMENT PANELS

CROSS REFERENCE TO RELATED APPLICATION

This application claims priority to U.S. provisional application No. 60/148,834, filed Aug. 13, 1999. This application is hereby incorporated by reference as if fully disclosed herein.

BACKGROUND OF THE INVENTION

1. Field of the Invention

The present invention relates to coverings for the ceilings and walls of building structures and, more particularly, to a drop ceiling or a wall panel wherein individual panels are supported on a matrix of support members.

2. Description of the Relevant Art

The ceilings of building structures have taken numerous forms. Ceilings may be left unfinished so that rafters or beams of the building structure itself are exposed or the rafters and beams may be covered as with drywall, wood strips, plaster or other similar finishes. Walls of building structures may be similarly finished.

Another popular ceiling system is commonly referred to as a drop ceiling where a plurality of support bars are suspended from the unfinished ceiling so as to form a matrix having a plurality of side-by-side openings defined between the support bars. The openings are filled with panels which are typically rigid acoustical panels, with the panels being supported along their peripheral edge by the support bars. While such drop ceilings have met with some success, there are numerous disadvantages. One disadvantage is that there is very little variety in the aesthetics of the ceiling system since most acoustical panels have the same general appearance, with another disadvantage residing in the fact that the panels are rigid and brittle so that they are easily breakable and, further, due to their rigidity, they are difficult to insert into the opening provided therefor inasmuch as the support bars must partially protrude into the opening in order to provide a support surface for the panels.

It is to overcome the shortcomings in prior art drop ceiling systems and to provide a new and improved cladding system for walls or ceilings that the present invention has been made.

SUMMARY OF THE INVENTION

The present invention pertains to a new and improved drop ceiling system wherein a plurality of flexible panels are preferably removably supported on a grid work of support bars. The support bars may be of inverted T-shaped cross-sectional configuration and form a matrix from longitudinally extending stringers and laterally extending cross-members. The flexible panels are sized to fit within the openings defined by the stringers and cross-members and rest upon ledges of the inverted T-shaped support members.

The panels can take numerous configurations but include at least one sheet of somewhat rigid but flexible or foldable material preferably made of a fibrous material that is reinforced in one of numerous ways so that it can be folded or flexed while being inserted into an opening in the supporting grid work and subsequently unfolded above the grid work so that it can be easily positioned on the supporting grid work. In various disclosed embodiments, the panel can be made to be collapsible or compressible.

The sheet material can be reinforced by a second parallel sheet of material with support members bridging the space therebetween or it may be reinforced simply by a plurality of reinforcing members extended along an unexposed, or possibly even exposed, surface of the sheet material. Where multiple sheets of material are utilized, support members are provided for retaining the sheet materials in a desired spaced relationship.

The panels so formed provide adequate insulation and also, in most instances, provide an exposed planar surface that can be covered with a decorative film of various colors, grains or textural patterns to provide variety to the aesthetics of the ceiling system once it has been installed.

While the panels have been summarized and will be described hereafter in more detail as forming part of a ceiling system, it will be apparent to those skilled in the art that with modification of the support system the panels could also be used in the walls of a building structure.

Other aspects, features and details of the present invention can be more completely understood by reference to the following detailed description of a preferred embodiment, taken in conjunction with the drawings and from the appended claims.

BRIEF DESCRIPTION OF THE DRAWINGS

FIG. 21 is a side elevation of a third embodiment of a panel in accordance with the present invention with the panel being similar to the panel shown in FIG. 18 but with a second parallel sheet of material.

FIG. 22 is an enlarged fragmentary side elevation of a portion of the panel of FIG. 21.

FIG. 23 is an enlarged fragmentary isometric view of the panel shown in FIG. 21.

FIG. 24 is a fragmentary isometric view of the reinforcement portion of the panel of FIG. 21 showing a first method of applying glue to the reinforcement.

FIG. 25 is a view similar to FIG. 24 with a second method of applying glue to the reinforcement material.

FIG. 26 is a view similar to FIG. 24 illustrating a third method of applying glue to the reinforcement.

DESCRIPTION OF THE PREFERRED EMBODIMENTS

Figure 1:
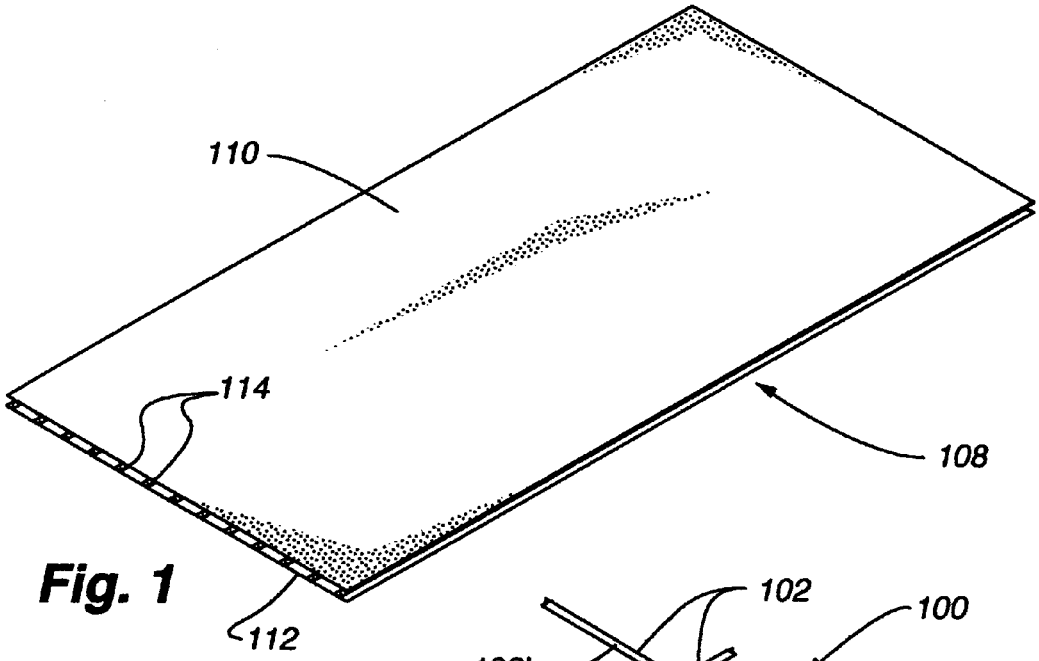
FIG. 1 is an isometric view of a panel formed in accordance with a first embodiment of the present invention.
Figure 2:
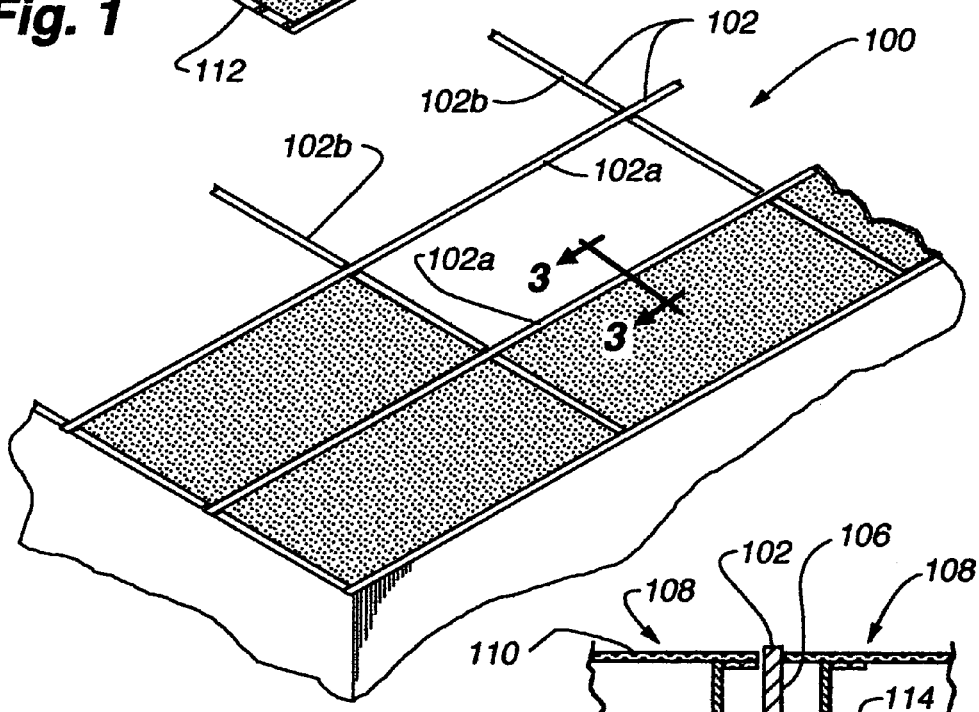
FIG. 2 is a fragmentary isometric view looking upwardly at a drop ceiling system in accordance with the present invention utilizing the panels of FIG. 1.
Figure 3:
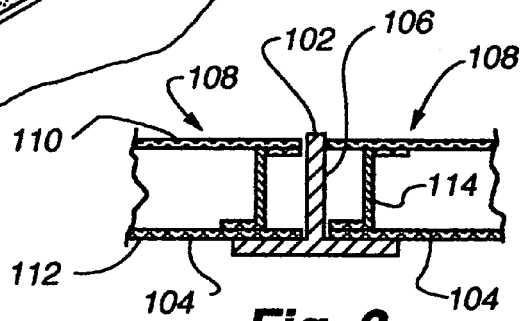
FIG. 3 is an enlarged fragmentary section taken along line 3—3 of FIG. 2.
Figure 4:
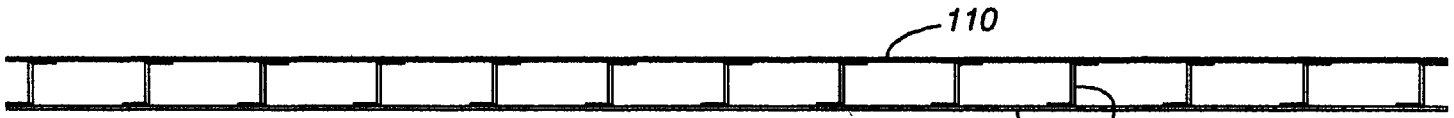
FIG. 4 is an enlarged side elevation of the panel of FIG. 1.

A drop ceiling system 100 in accordance with the present invention utilizes a conventional suspension system of elongated crisscrossing support members 102 forming a matrix defining openings that are usually rectangular in shape in which a panel in accordance with the present invention can be disposed. The support members typically consist of horizontally disposed elongated stringers 102*a* that are suspended in a conventional manner and in parallel relationship in one direction across a ceiling structure usually at a vertical spacing of four to six inches from the substructure of the building structure in which the ceiling system is mounted. A plurality of horizontal cross-support members 102*b* extend in parallel relationship and perpendicularly to the stringers so that the quadrangular openings are defined therebetween. The cross-members are also suspended at the same elevation as the stringers. The stringers and cross-members are of inverted T-shaped cross-section as illustrated in FIG. 3 so as to define horizontal shoulders 104 on either side of a vertical body 106, with the shoulders being adapted to support a peripheral edge of a panel formed in accordance with the present invention. As will be appreciated, the T-shaped support members 102 extend peripherally around each quadrangular opening so that a shoulder is provided to support an entire peripheral edge of a panel.

Other types of suspension systems could be utilized, but a suspension system of the type described has proven to be very functional.

A first embodiment 108 of a panel in accordance with the present invention is illustrated in FIGS. 1–17. As probably best seen in FIG. 5, each panel 108 includes an upper planar sheet 110, a lower planar sheet 112 and a reinforcement layer including a plurality of parallel reinforcement members 114 of substantially S-shaped cross-section. The upper and lower planar sheets as well as the reinforcement members are made of a somewhat rigid material than can be flexed. A material that has worked for this purpose is a non-woven fabric of heat resistant fibers bound together by a heat moldable polymeric resin matrix or a thermal setting resin matrix. For example, fiberglass fibers embedded in an acrylic resin will work for this purpose with the fibers preferably being relatively long and thin. The length of the glass fibers would preferably be in the range of ¼ inch to one inch. The thickness of the glass fibers would preferably be no less than 7 microns and no more than 100 microns with 10–16 microns having proven to be desirable. A material found suitable for this purpose is 100GSM glass mat #8802 manufactured by Johns Manville of Waterville, Ohio, or an alternative would be materials available from OJI Glasspen in Japan and Ahlstrom in England.

The upper and lower sheets of material are cut to a predetermined size which corresponds with the area defined by the stringers 102*a* and cross-members 102*b* of the support system. As will be appreciated, the upper and lower sheets of material are retained in a parallel and separated relationship by the reinforcement members 114 which are formed from elongated strips of material 116 that are pre-creased at predetermined locations so that they can be folded at right angles at those locations. The strips of material are also cut to pre-determined lengths to form the reinforcement members.

Figure 5:
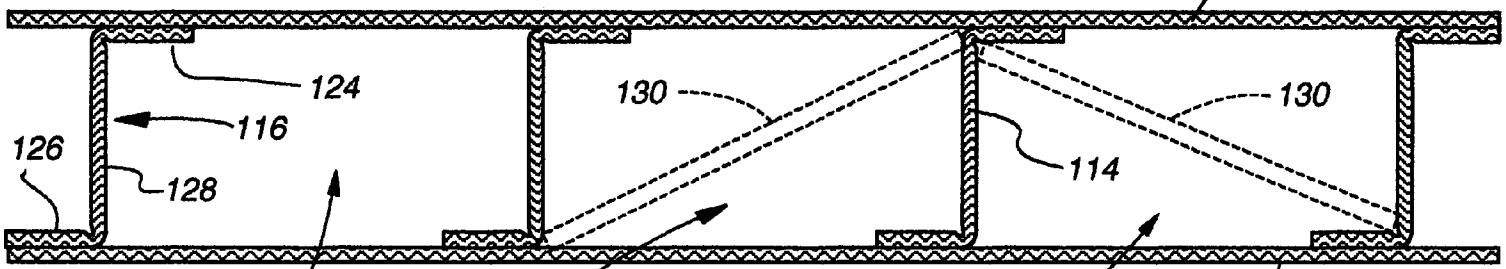
FIG. 5 is an enlargement of a section of FIG. 4 showing support members for the panel in dashed lines.
Figure 7:
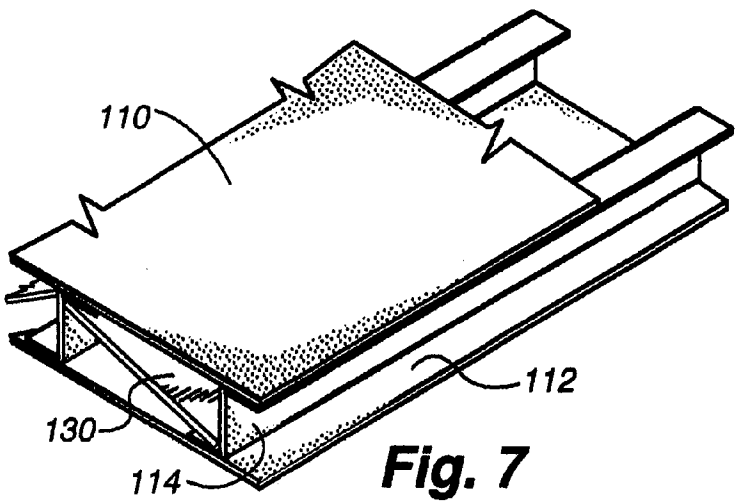
FIG. 7 is a view similar to FIG. 6 with a support member of the type shown in dashed lines in FIG. 5 shown in solid lines.
Figure 6:
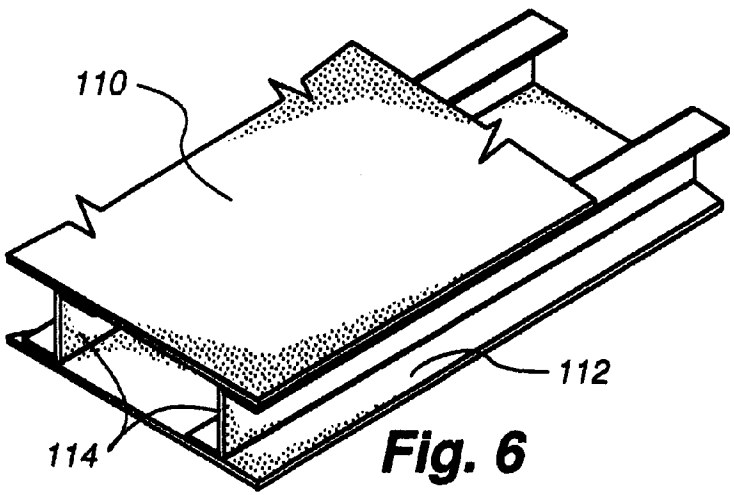
FIG. 6 is an enlarged fragmentary isometric view of the panel of FIG. 1.

The creases are provided at the locations where the strip material 116 is to be folded and these locations are spaced from each edge of the strip approximately one-quarter of the full width of the strip. In this manner, when the strips are folded as illustrated in FIG. 5, they define an upper flap 124 and a lower flap 126 and an intermediate body 128 which is approximately twice the width of each of the flaps. The crease lines, of course, allow the flaps to be folded relative to the intermediate body. By taking care when creasing the strips that the glass fibers not be damaged, alternative means for maintaining resiliency in the strip material need not be employed as the glass fibers provide the desired resiliency in the material. For purposes of the present disclosure, resiliency refers to the ability of a material, component or panel to return, after deformation, to its pre-deformed configuration. Each flap is provided with an adhesive on its outer surface to engage the adjacent sheet material 110 or 112 so as to be securely bonded thereto. The adhesive could take numerous forms but a porous adhesive made by EMS-Chemie AG of Domat/Ems, Switzerland and designated flame resistant co-polyester adhesive #1533 has been found acceptable.

Figure 11:
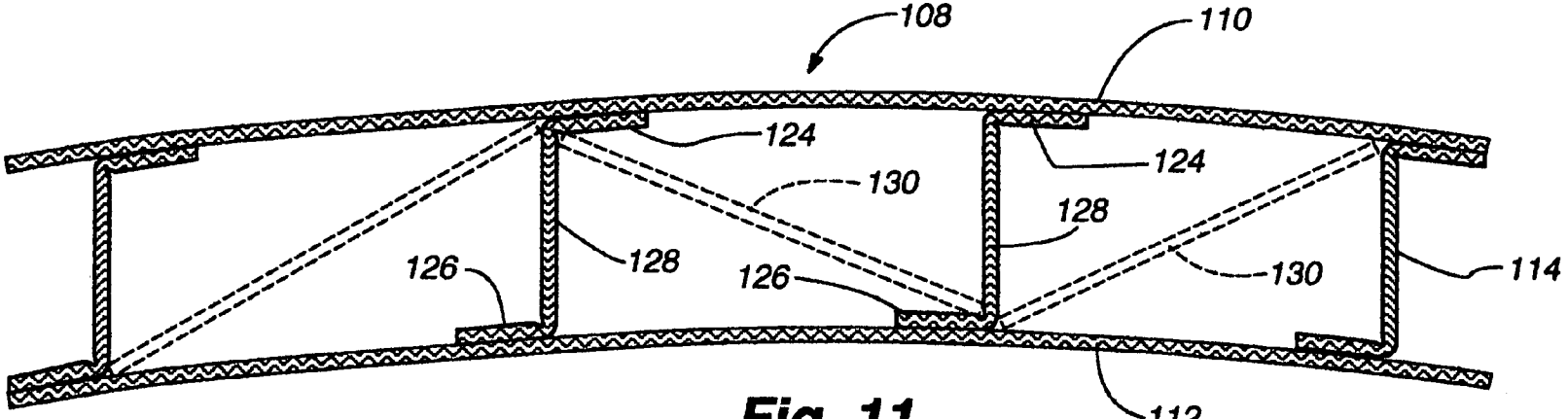
FIG. 11 is a view similar to FIG. 5 showing the panel partially folded or bent which facilitates insertion of the panel into a position within the supporting grid work for the ceiling system.
Figure 12:
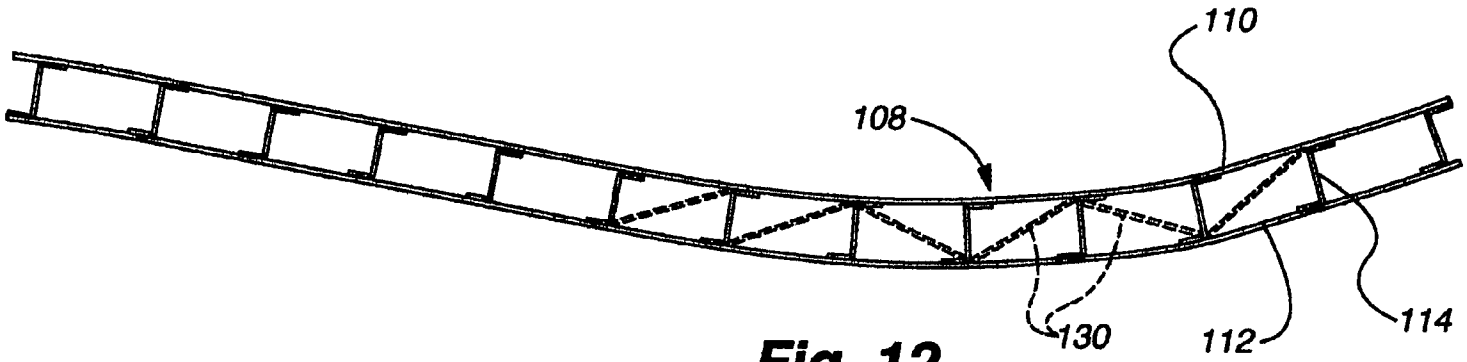
FIG. 12 is a reduced side elevation similar to FIG. 11 again showing the panel slightly folded or bent.

As will be appreciated, due to the creases in the reinforcement members, and the capability of the strip material 116 to bend along these creases, the reinforcement members by themselves may not necessarily retain the sheet material 110, 112 in spaced relationship rendering the panel collapsible by moving the sheets of material toward each other while they slightly shift laterally relating to each other. To prevent collapsing, diagonal support members 130 of a more rigid plastic material or conceivably the same glass fiber reinforced resin material may be diagonally inserted into each cell 132 defined between the sheet material and adjacent reinforcement members. These support members 130 are illustrated in dashed lines in FIG. 5 and in full lines in FIG. 7. The support members can be inserted in every cell or in spaced cells as is necessary to support the panel as desired. Even with the support members inserted in each cell, however, the panel can be slightly flexed or bent as illustrated in FIG. 11 or 12. As will be appreciated, due to the flexibility of the panels, they can be easily inserted into the openings between the stringers 102*a* and cross-members 102*b* even though the overall fully extended size of the panel 108 is substantially equal to the size of that opening. This, of course, provides a distinct advantage over systems in the prior art where rigid panels that could not be bent or flexed have to be inserted into an opening of about the same size.

By inserting support members at specified selected locations, but not in all the cells, the panel will take a curved shape that may be useful or appealing in some situations.

The reinforcement members 114 can be adhesively bonded to the sheet material 110, 112 in any suitable manner but, by way of example, the adhesive could be provided to cover the entire face of a flap 124 or 126, could be provided in continuous lines along the flap but not of the full width of the flap, could be provided in intermittent lines along the flap or other such applications. It is conceivable that the reinforcement member could also be heat welded or ultrasonically bonded to the sheet material as well.

Figure 8:
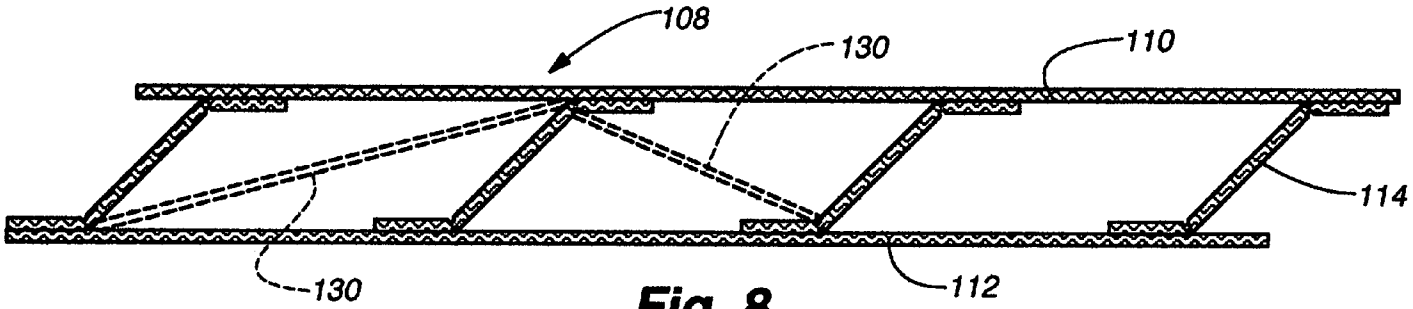
FIG. 8 is a view similar to FIG. 5 with the panel being folded and with the support members shown in dashed lines where they would be incorporated if the panel were fully expanded as shown in FIG. 5.
Figure 9:
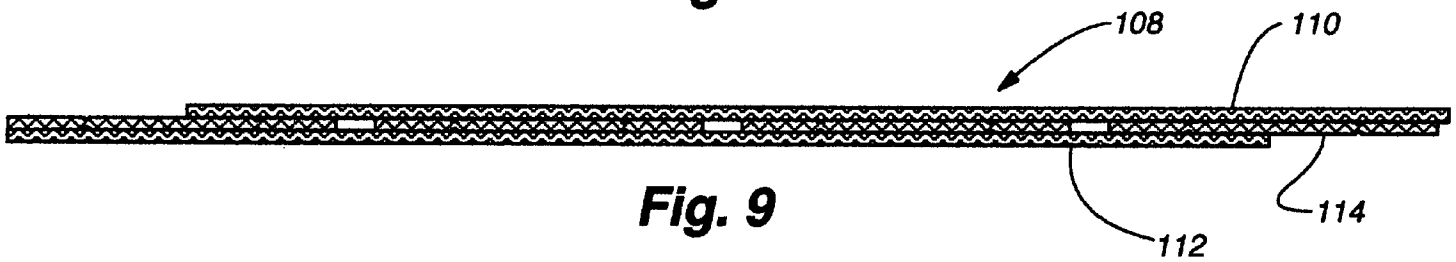
FIG. 9 is a side elevation of the panel of FIG. 8 after having been fully folded into a flat condition.
Figure 10:
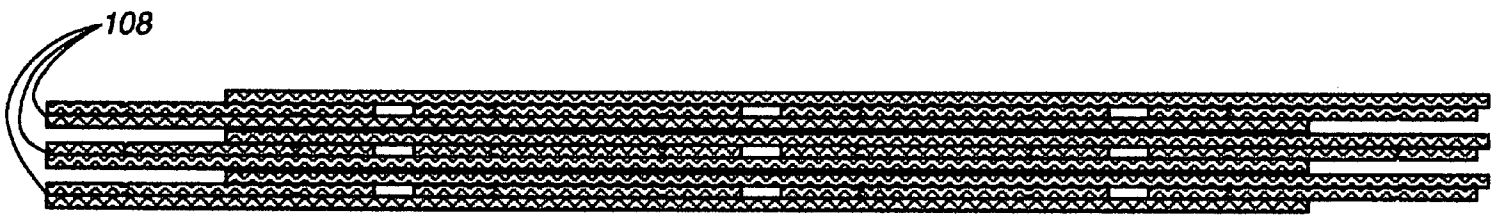
FIG. 10 is a side elevation showing three panels in a fully folded condition and stacked upon each other.

It will be appreciated by reference to FIGS. 8–10 that by removing the support strips 130 from each cell, the panel 108 can be collapsed by folding the reinforcement members 114 along their creases 122 so that the reinforcement members are flattened and extend in parallel relationship with the upper and lower sheets 110 and 112, respectively, as illustrated in FIG. 9. In this configuration, panels can be stacked as illustrated in FIG. 10 into a small area for shipping purposes thereby saving considerable expense when shipping panels for use in a drop ceiling system.

Figures 13, 14:
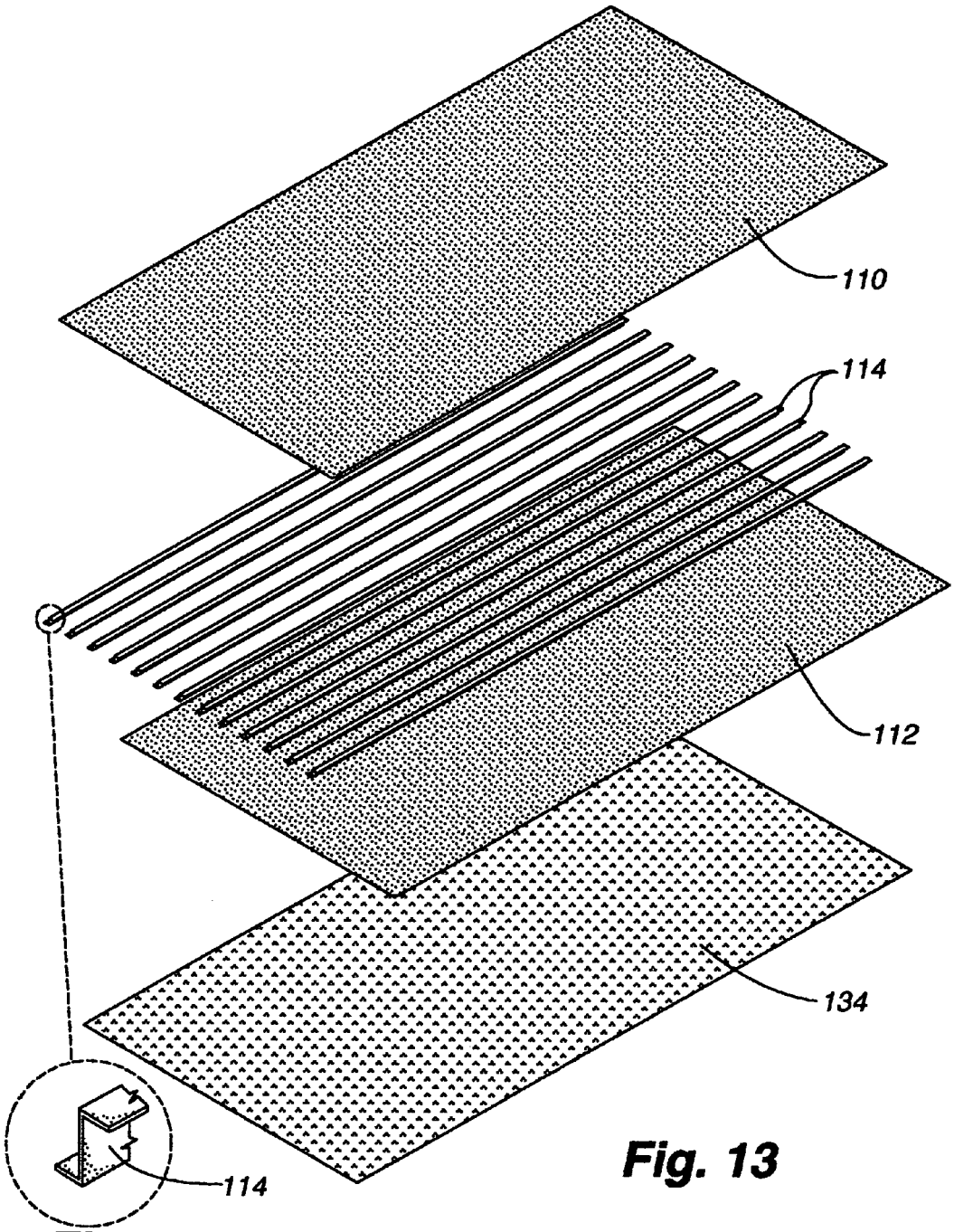
FIG. 13 is an exploded isometric view of the panel of FIG. 1 but including a decorative film layer for covering the lower face of the panel of FIG. 1.
FIG. 14 is an enlarged view of the circled area of FIG. 13.

With reference to FIG. 13, it will be appreciated that the panel 108 as described above can be modified by incorporating a decorative continuous layer of elastomeric polymer, preferably a thermoplastic or thermosetting polymeric film 134 or the like, such as a urethane or neoprene film, to the lower exposed face of the lower sheet 112, which face is the face that is exposed to the interior of the room in which the ceiling system is mounted. The film material can be simply a flat sheet of colored material, could be furrowed or otherwise embossed with a pattern, or could have a wood grain or other decorative pattern imprinted thereon. There are numerous possibilities for decorating the lower surface of the panel and this film or related sheet of material can be adhesively or otherwise secured to the panel along the bottom face of the lower sheet of material 112 of the panel. A decorative film as described above or other material may also be applied to the other panel embodiments of this invention, which are described below.

Examples of decorative coverings or films would be:

a) supported vinyl wall coverings made by Gen Corp. of Columbus, Miss.
b) unsupported vinyl films as used in wrapping operations from Alkor Draka of Munich, Germany.
c) flame resistant papers made by Pallas Inc. of Green Bay, Wis.
d) flame resistant papers made by Permalin Products Co. of New York, N.Y.
e) woven fiberglass mat from Johns Manville of Waterville, Ohio.
f) a flame resistant non-woven #TR2315B-1 from H & V of Floyd, Va. which has been quilted by Hunter Douglas Inc. of Broomfield, Colo.
g) a flame resistant glass paint on a glass non-woven fabric with the paint being manufactured by Keim of Holland. The glass non-woven fabric would come from Alkstrom of Finland.

Figure 15:
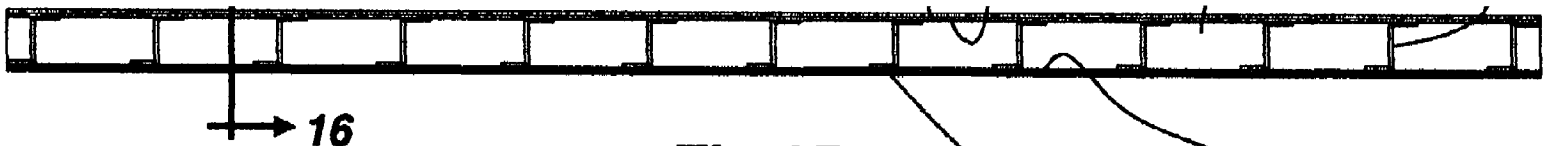
FIG. 15 is a side elevation of a panel as shown in FIG. 1 with end caps running along opposite ends of the panel to retain the panel in an expanded condition.
Figure 17:
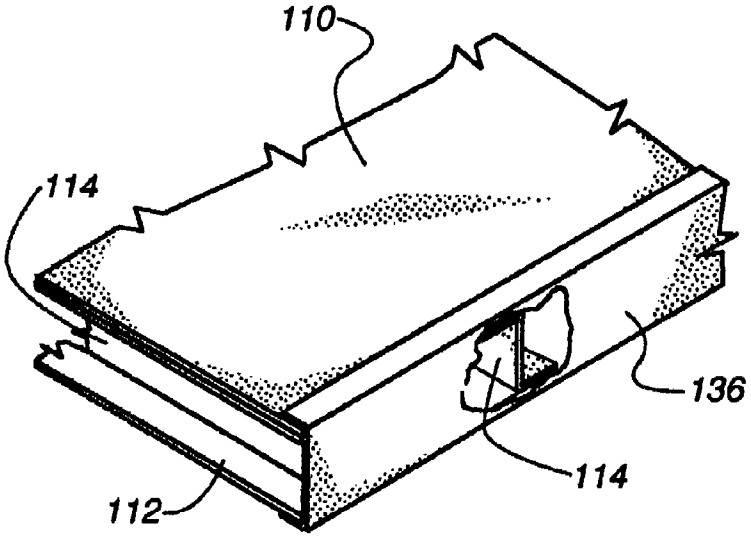
FIG. 17 is a fragmentary isometric view with parts broken away of the panel shown in FIGS. 15 and 16.
Figure 16:
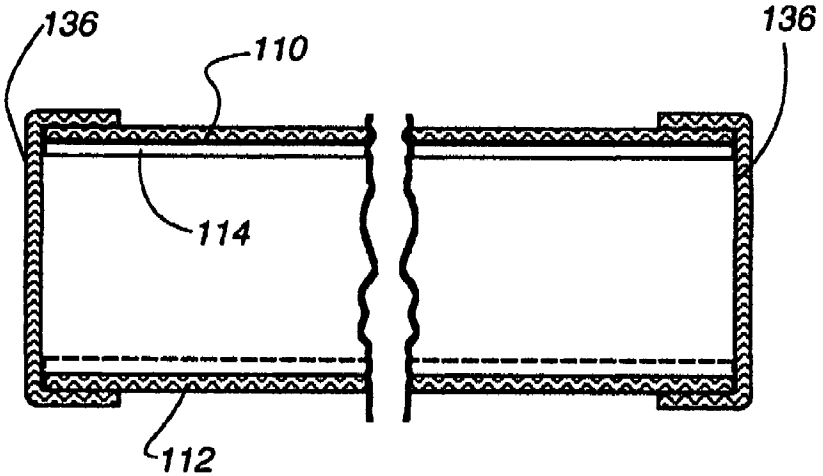
FIG. 16 is an enlarged fragmentary section taken along line 16—16 of FIG. 15.

As an alternative to the diagonal support members shown in dashed lines in FIG. 5, elongated end caps 136 as shown in FIGS. 15–17 could be utilized. These end caps could simply be elongated U-shaped channel members of a rigid material which are adapted to fit snugly over the end of the aforedescribed panel 108 in perpendicular relationship to the longitudinal direction of the reinforcement members 114. As will be appreciated, the end caps prevent the panel from collapsing, as illustrated in FIGS. 8 and 9, and, of course, could be removed from the panel for shipping purposes and installed on the panel once the panels were ready for installation in a ceiling system. As an alternative the end caps could also be slit to fit within the open end of the panel instead of around the end. By way of example, the end caps could be made of a flame resistant polycarbonate or aluminum and adhesively secured to the panels 108.

Figure 18:
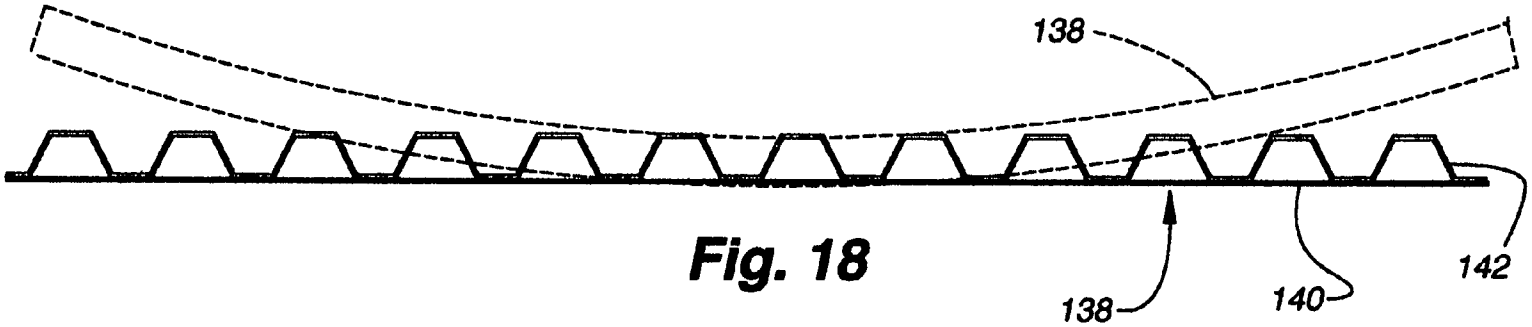
FIG. 18 is a side elevation of a second embodiment of a panel in accordance with the present invention with the panel shown folded in dotted lines.
Figure 19:
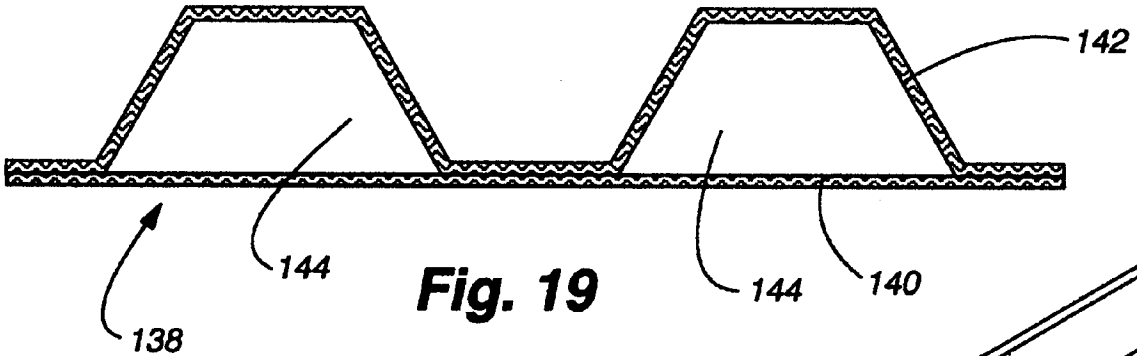
FIG. 19 is an enlarged fragmentary side elevation of a portion of the panel shown in FIG. 18.
Figure 20:
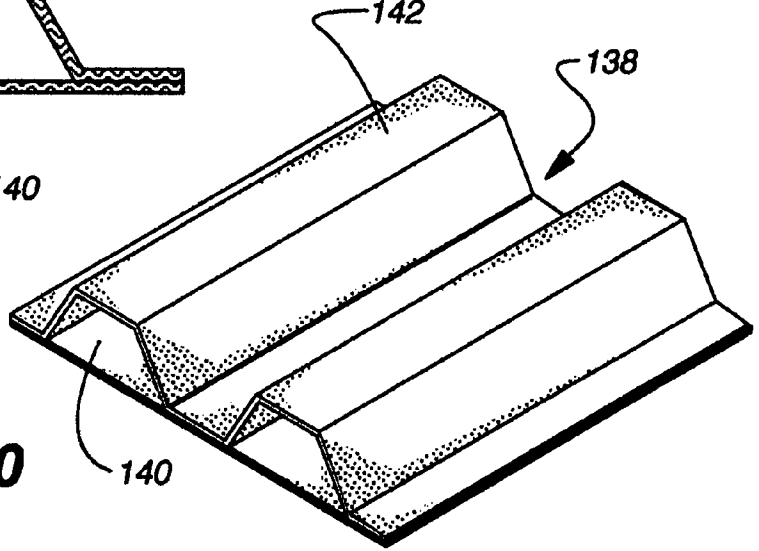
FIG. 20 is a fragmentary isometric of the panel as shown in FIG. 19.
Figure 27:
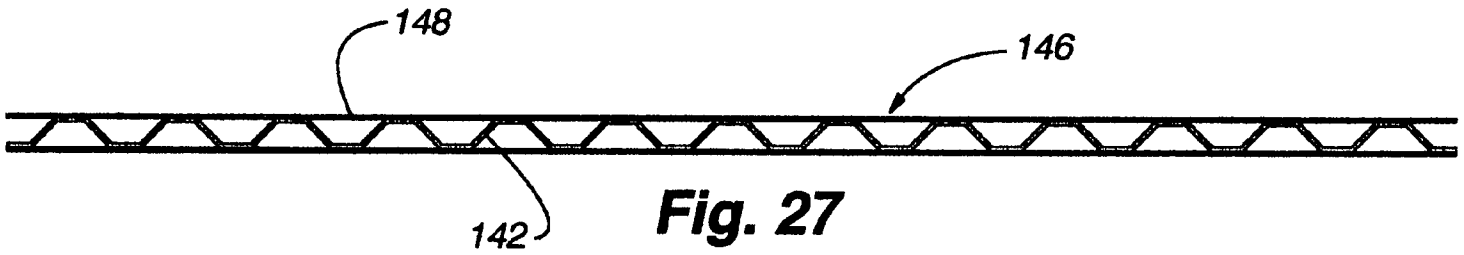
FIG. 27 is a side elevation similar to FIG. 21 with the panel of FIG. 21 having been partially compressed.
Figure 28:
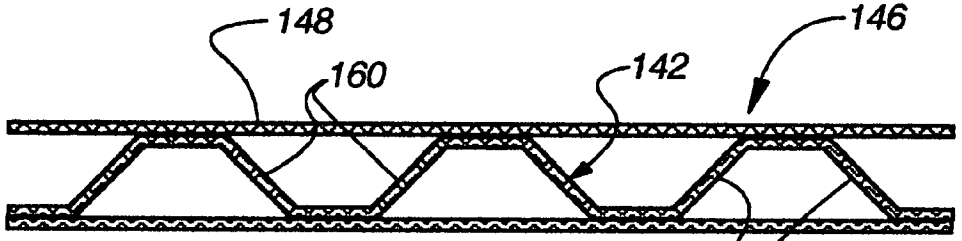
FIG. 28 is an enlarged fragmentary section of the panel as seen in FIG. 27.

FIGS. 18–20 illustrate a second embodiment 138 of a panel in accordance with the present invention wherein a lower sheet material 140 is reinforced principally in one direction by a furrowed reinforcing sheet 142 that is folded as illustrated in FIG. 19 to define upwardly and downwardly opening trapezoidal channels 144. The trapezoidal channels would be bonded where the reinforcement member is in contiguous abutting face-to-face relationship with the lower sheet material 140. As mentioned previously, the bonding could be done in any variety of ways so long as a positive bond was provided between the reinforcing member and the lower sheet material. As will be appreciated, with an arrangement of this type, the panel can be flexed upwardly in a smooth curve, as illustrated in FIG. 18, and to a smaller degree downwardly but only in one direction of the panel. The trapezoidal channels 144 substantially prevent flexing in a transverse direction to that illustrated. This ability to flex the panel, however, allows the panel to be easily inserted into the opening between the stringers 102*a* and cross-members 102*b* in the support structure for the ceiling system. The stiffness of the panel can also be adjusted by the stiffness or rigidity of the lower sheet material 140.

In a third embodiment 146 of the present invention, seen in FIGS. 21–30, the ceiling panel 146 is formed similarly to the panel illustrated in FIGS. 18–20 but wherein an upper sheet material 148 is secured to the trapezoidal reinforcement member 142 along the top surface of the trapezoidal member. The upper sheet material can be adhesively bonded or otherwise secured to the reinforcement member in the same or similar manner as the reinforcement member was secured to the lower sheet material 140. As illustrated in FIG. 24, the bonding of the reinforcement member 142 to the sheet material can be with a full layer of adhesive 150 or, as illustrated in FIG. 25, with a single line of adhesive 150 or, as illustrated in FIG. 26, with parallel lines of adhesive 150 or, as mentioned previously, many other methods of applying adhesive such as intermittently or in dots or the like could also be employed. Again, heat welding or ultrasonic bonding may also be appropriate.

The completed panel 146 is probably best seen in FIG. 23 and, again, will bend or flex in one direction of the panel but is substantially prevented from flexing in a lateral or perpendicular direction due to the trapezoidally shaped channels of the reinforcement member 142. The reinforcement member can be formed from a sheet of material that has been creased in opposite faces at spaced parallel locations and subsequently folded.

Figure 29:
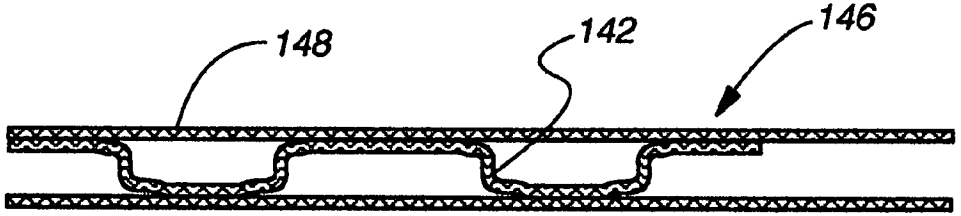
FIG. 29 is a fragmentary section similar to FIG. 28 with the panel having been further compressed.
Figure 30:
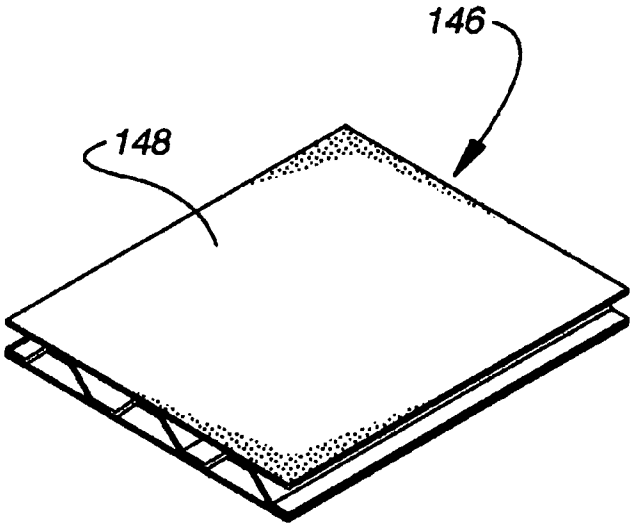
FIG. 30 is an isometric view of the panel as shown in FIG. 27 partially compressed.

The panel 146 can be compressed for shipping purposes, as illustrated in FIGS. 27–30, with a slight amount of compression probably not appreciably changing the configuration of the panel other than to make it slightly thinner, but further compression causing the straight faces 160 of the reinforcement member to buckle or fold into the contoured configuration shown in FIG. 29. Accordingly, the panels can be forcibly compressed for shipping purposes so as not to occupy as much space within a shipping container and by utilizing an appropriate material for the panels, such as a glass reinforced resin as described previously, the panels will reassume their normal configuration of FIGS. 21 and 22.

For purposes of the present disclosure, the term "compression" refers to reducing the thickness of a panel without allowing the upper and lower sheets to shift laterally relative to each other while the term "collapsing" refers to reducing the thickness of a panel while permitting lateral shifting of the upper and lower sheets relative to each other. If there were no upper sheet, such as in the embodiment shown in FIGS. 18–20, "compression" would occur if the furrowed reinforcing sheet were not allowed to fold laterally as if it were "collapsing" but rather was buckled straight downwardly.

Figure 31:
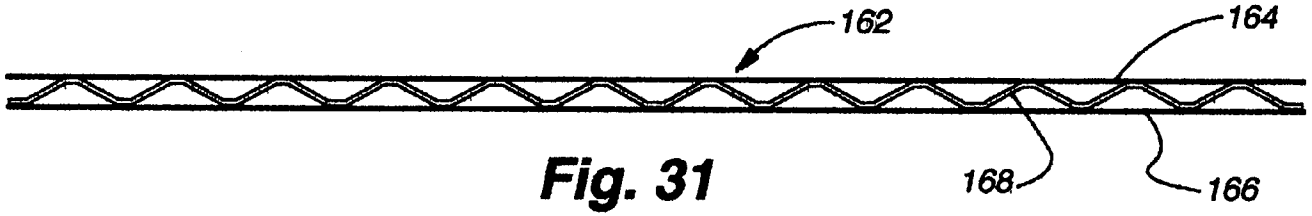
FIG. 31 is a side elevation of a fourth embodiment of a panel formed in accordance with the present invention.
Figure 32:
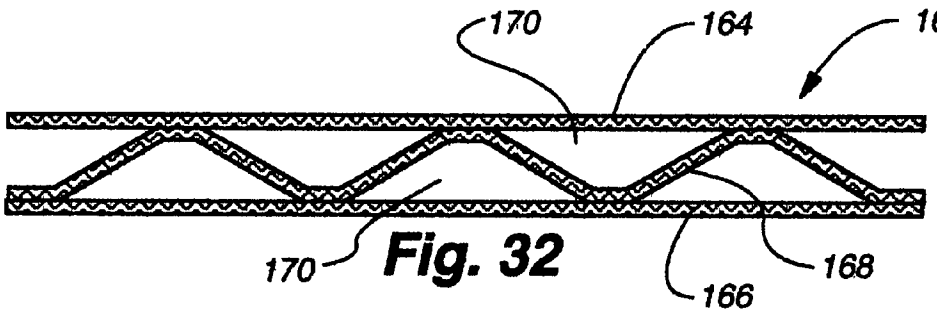
FIG. 32 is an enlarged fragmentary section of a portion of the panel as shown in FIG. 31.
Figure 34:
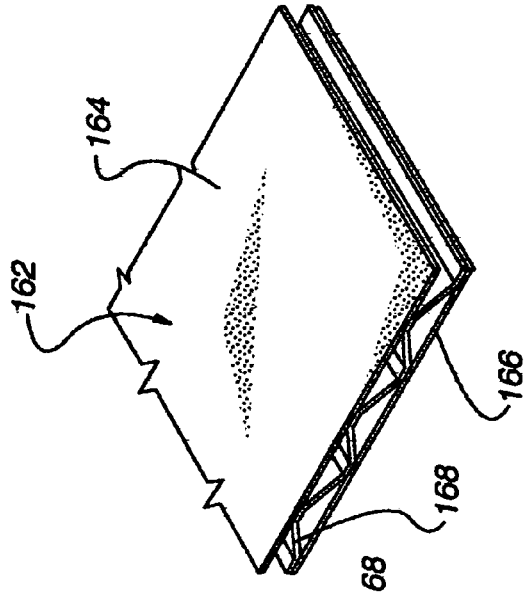
FIG. 34 is a fragmentary isometric of the panel shown in FIG. 31.
Figure 33:
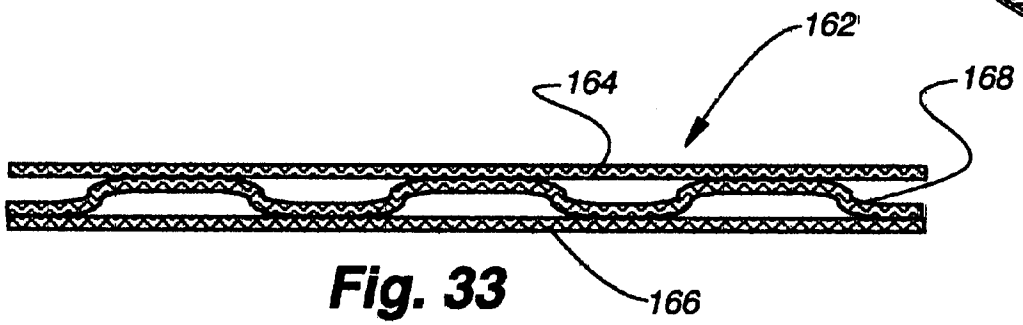
FIG. 33 is a fragmentary section similar to FIG. 32 with the panel partially compressed.

FIG. 31 illustrates a fourth embodiment 162 of the present invention where, again, upper and lower planar sheets of material 164 and 166, respectively, are separated by a furrowed reinforcement member 168 that defines upwardly and downwardly opening channels 170 of trapezoidal cross-section but in this embodiment of the invention, the engagement area of the reinforcement member 168 with each planar sheet member 164, 166 is less than the corresponding engagement areas of the panel shown in FIGS. 21 and 22. This allows for a more compressible panel and as will be appreciated, by varying the area of engagement between the reinforcement member and the planar sheet members, the compressibility of the panel can be regulated. FIG. 33 shows the panel 162 in a somewhat compressed configuration but when utilizing appropriate resilient materials, the panel will return to the normal configuration illustrated in FIG. 32 upon the release of pressure due to the resiliency of the material utilized.

Figure 35:
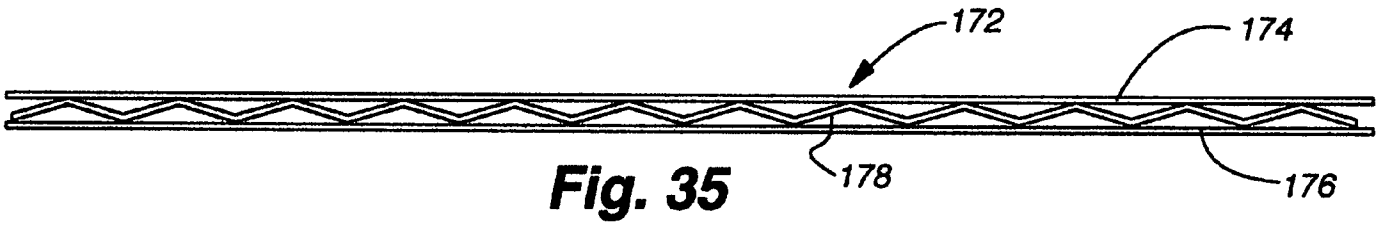
FIG. 35 is a side elevation of a fifth embodiment of a panel formed in accordance with the present invention.
Figure 35A:
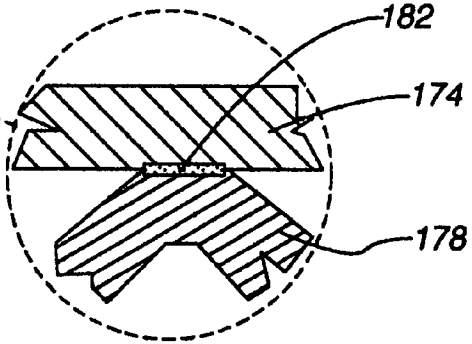
FIG. 35A is an enlargement of the circled area of FIG. 36.
Figure 38:
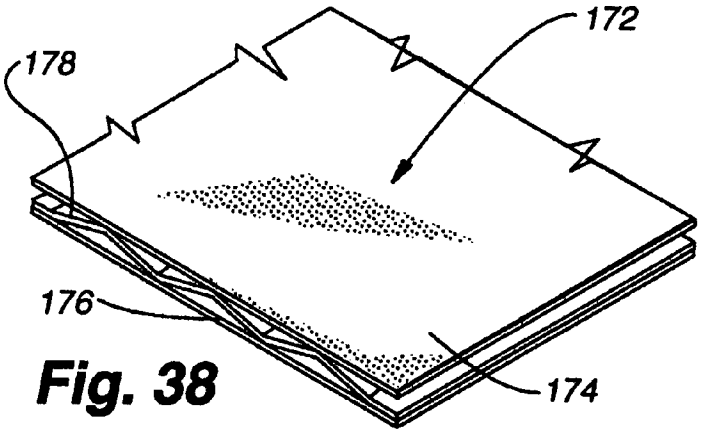
FIG. 38 is a fragmentary isometric of the panel shown in FIG. 35.
Figure 36:
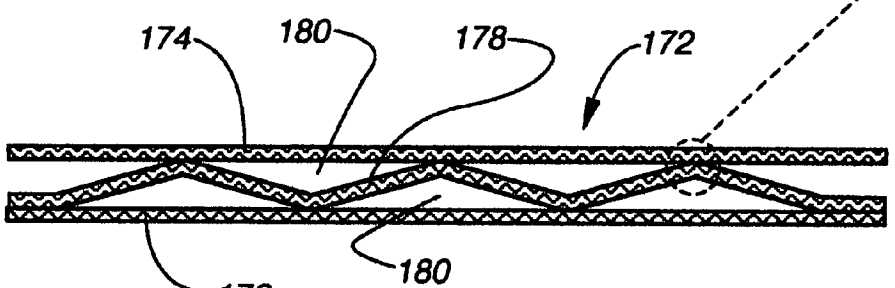
FIG. 36 is an enlarged fragmentary section illustrating a portion of the panel shown in FIG. 35.
Figure 37:
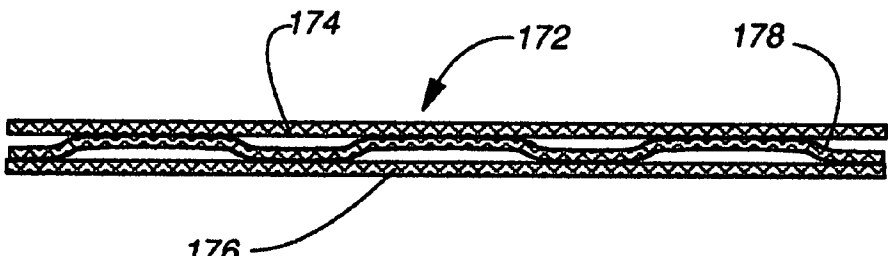
FIG. 37 is a fragmentary section similar to FIG. 36 with the panel having been partially compressed.

FIGS. 35–38 illustrate a fifth embodiment 172 of the present invention which is somewhat similar to those shown in FIGS. 21–22 and 31–32 so as to include upper and lower sheets of planar material 174 and 176, respectively, and a reinforcing member 178 therebetween but wherein the reinforcing member is defined by upwardly and downwardly opening channels 180 that are of substantially triangular configuration. In this arrangement, the engagement of the reinforcing member 178 with each planar sheet material 174, 176 is a relatively small area which allows even more compressibility of the panel. FIG. 35A is an enlargement of the circled area in FIG. 36 and shows a line of adhesive 182 along a substantially pointed line of engagement of the reinforcement member 178 with the upper planar sheet member 174.

Figure 39:
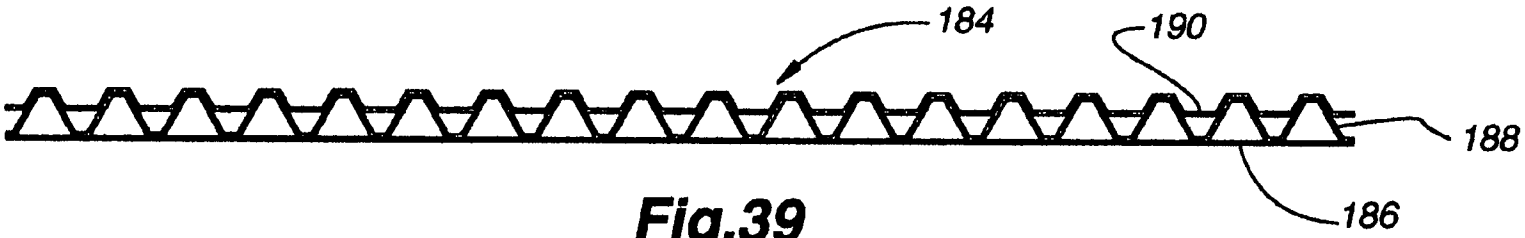
FIG. 39 is a side elevation of a sixth embodiment of a panel formed in accordance with the present invention.
Figure 40:
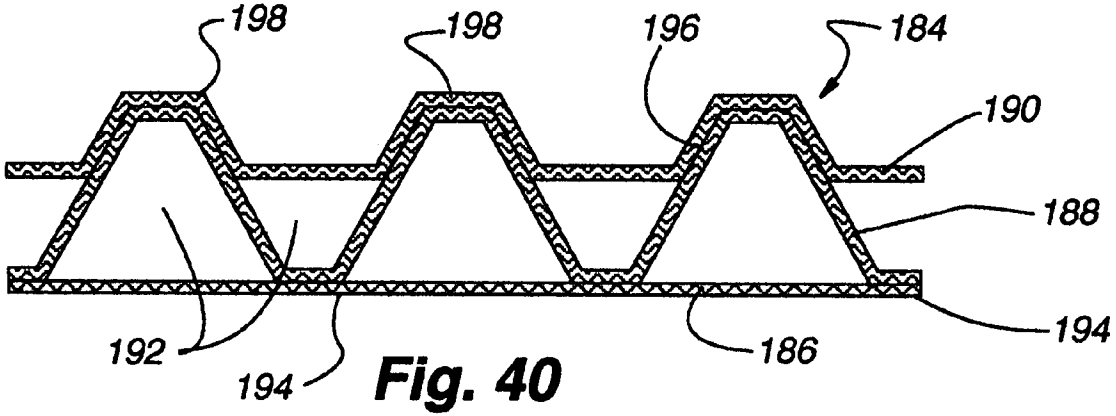
FIG. 40 is an enlarged fragmentary section of a portion of the panel shown in FIG. 39.
Figure 41:
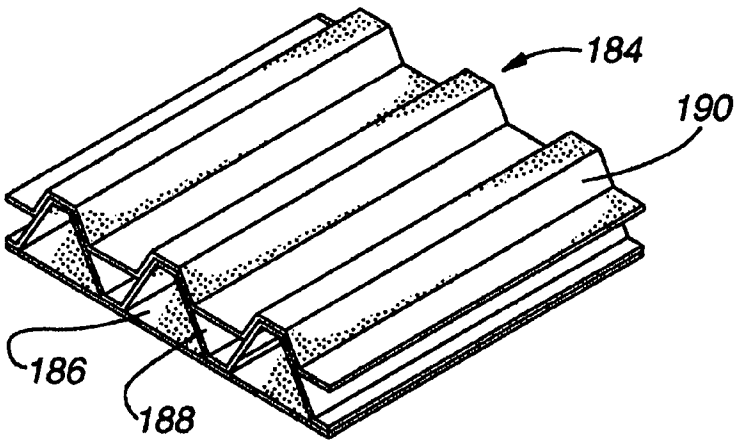
FIG. 41 is a fragmentary isometric of the portion of the panel shown in FIG. 40.

A sixth embodiment 184 of the panel of the present invention is illustrated in FIGS. 39–41 and can be seen to include a lower planar sheet material 186, a primary reinforcement member 188 substantially of the type shown in FIG. 18, and a secondary reinforcement member 190 overlaid on the primary reinforcement member 188.

Figure 45:
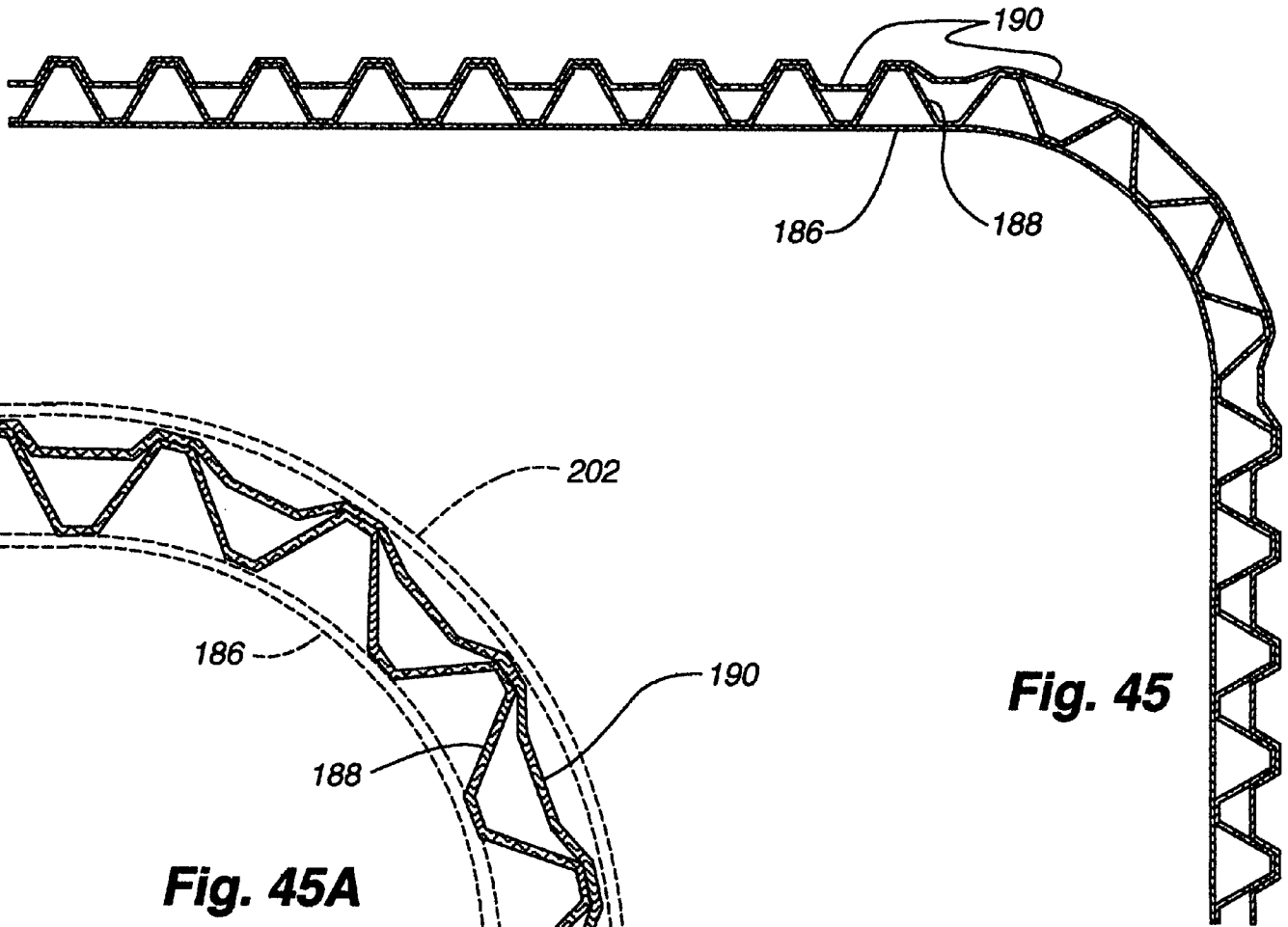
FIG. 45 is a side elevation of the panel shown in FIG. 39 with a fold or curve formed in the panel.

The primary reinforcement member 188 defines upwardly and downwardly opening channels 192 of trapezoidal cross-sectional configuration and is bonded to the lower planar sheet material 186 along areas of engagement 194. The secondary reinforcement member 190 is overlaid across the top of the primary reinforcement member and also defines upwardly and downwardly opening channels 196 of trapezoidal configuration but wherein the upwardly opening channels are wider than the downwardly opening channels. The downwardly opening channels are sized to conform with and receive the uppermost structure of a downwardly opening channel of the primary reinforcement member 188. The upwardly opening channels of the secondary reinforcement member 190 are adapted to be received in an upwardly opening channel of the primary reinforcement member. The secondary reinforcement member is secured to the primary reinforcement member in any suitable manner such as with adhesive and either continuously or at intermittent locations only along horizontal areas of engagement 198. The panel so formed, again, will flex in one direction but not as readily flex in the lateral transverse direction and FIG. 45 illustrates the panel when so flexed, It will be appreciated that the secondary reinforcement member flexes outwardly across the upwardly opening channels 192 of the primary reinforcement member to allow for the bend in the panel. This, of course, is permitted due to the fact that the secondary reinforcement member is not bonded to the primary reinforcement member in the upwardly opening channels of the primary reinforcement member but only along the top or horizontal areas of engagement 198 with the primary reinforcement member.

Figure 42:
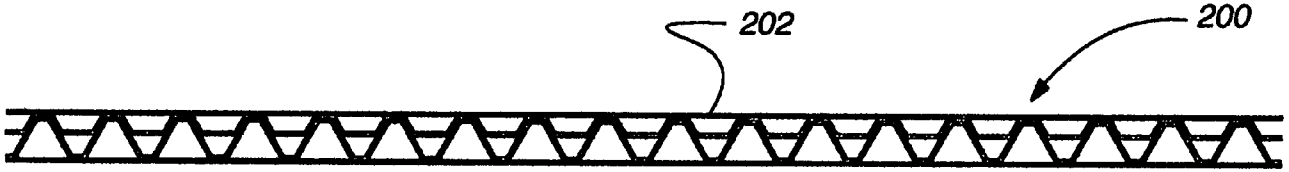
FIG. 42 is a side elevation of a panel similar to that shown in FIG. 39 with a parallel sheet of material added to the panel.
Figure 43:
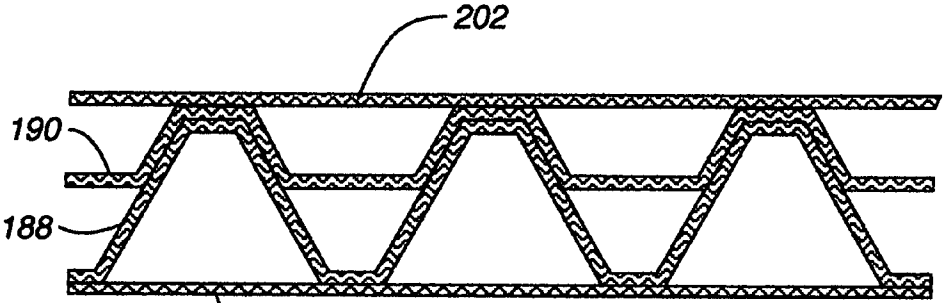
FIG. 43 is a fragmentary vertical section of a portion of the panel shown in FIG. 42.
Figure 44:
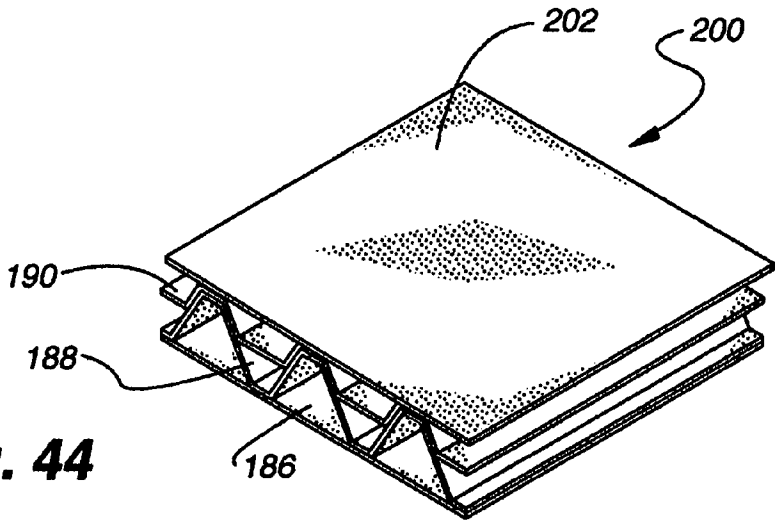
FIG. 44 is a fragmentary isometric of the portion of the panel shown in FIG. 43.
Figure 45A:
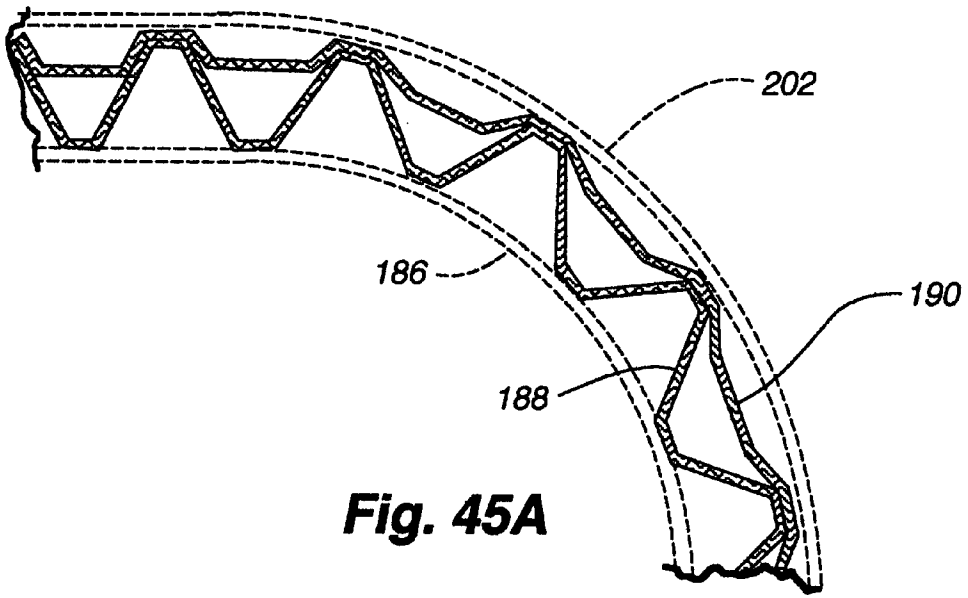
FIG. 45A is an enlarged view similar to FIG. 45 showing the reinforcement portion of the panel of FIG. 45 in solid lines and parallel sheets connected to the reinforcement portion in dashed lines.

FIGS. 42–44 illustrate an alterative arrangement 200 to the panel illustrated in FIGS. 39 and 40, with this alternative arrangement being identical to the arrangement shown in FIGS. 39 and 40 but wherein an upper planar sheet member 202 is bonded to the secondary reinforcement member 190 in parallel relationship with the lower planar sheet member 186. A panel so formed could also be bent as illustrated in FIG. 45A where the planar sheet members 186 and 202 are illustrated in dashed lines.

Figure 46:
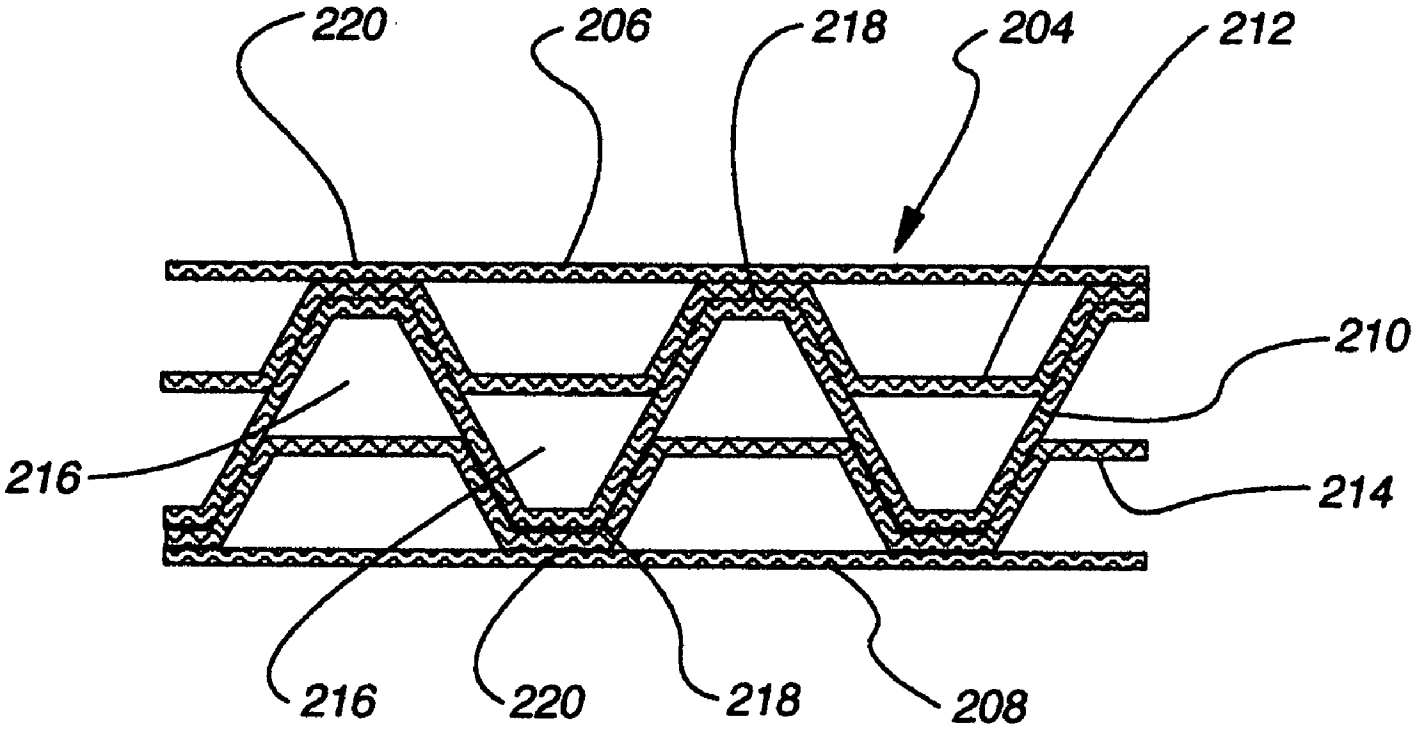
FIG. 46 is a fragmentary vertical section through a seventh embodiment of a panel formed in accordance with the present invention.
Figure 48:
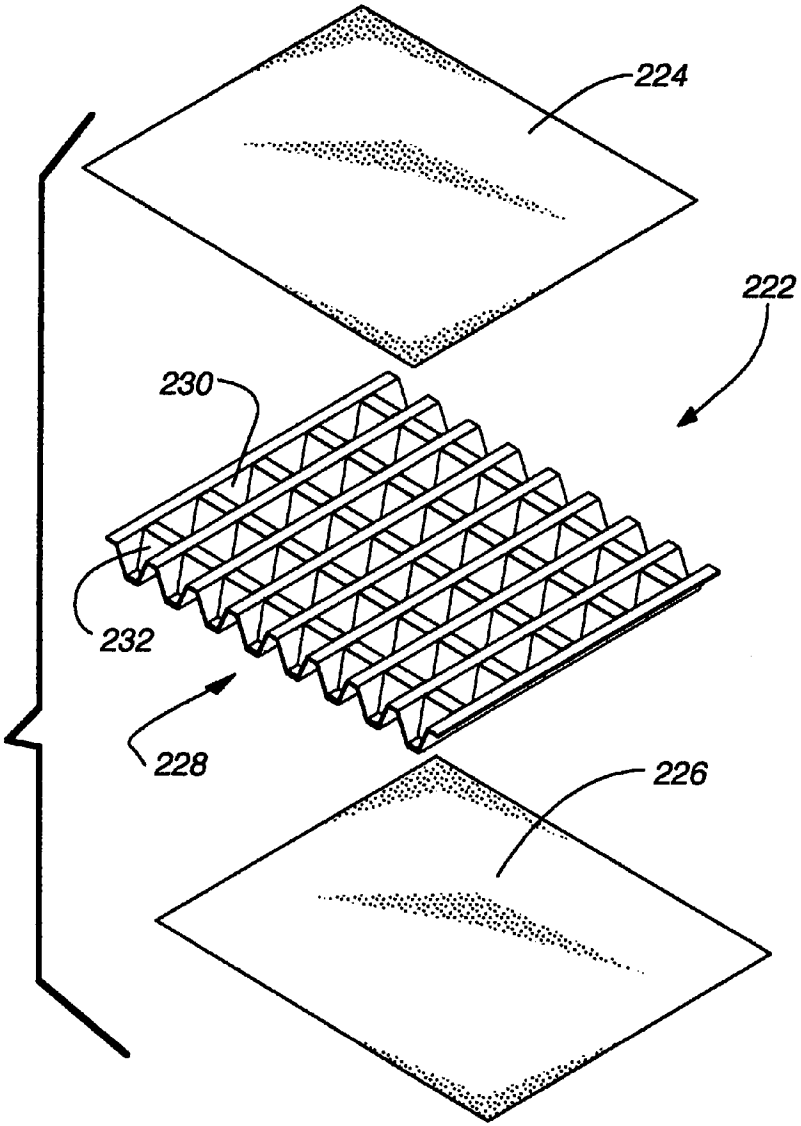
FIG. 48 is an exploded isometric view of the panel shown in FIG. 47.
Figure 47:
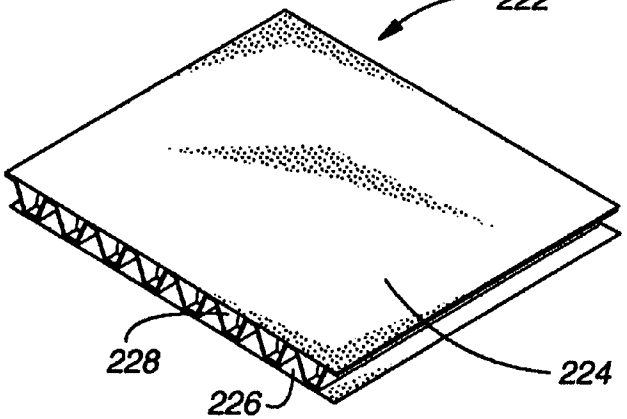
FIG. 47 is an isometric view of an eighth embodiment of a panel formed in accordance with the present invention.

FIG. 46 illustrates a seventh embodiment 204 of a panel in accordance with the present invention wherein the panel 204 includes upper and lower planar sheets of material 206 and 208, respectively, a primary reinforcement member 210 and a pair of upper and lower secondary reinforcement members 212 and 214, respectively. The primary reinforcement member has upwardly and downwardly opening channels 216 of trapezoidal configuration but the primary reinforcement member is not directly attached to the planar sheet materials. Rather, the secondary reinforcement members 212 and 214, respectively, are secured to the primary reinforcement member 210 along horizontal interfaces 218 between the respective members and, in turn, the secondary reinforcement members are secured to the planar sheet members along horizontal engagement areas 220. The secondary reinforcement members are identical to each other but inverted relative to each other so as to be secured to the primary reinforcement member across the top and bottom thereof substantially as described previously in connection with the embodiment of the invention shown in FIGS. 39 and 40.

Figures 49, 50, 51:
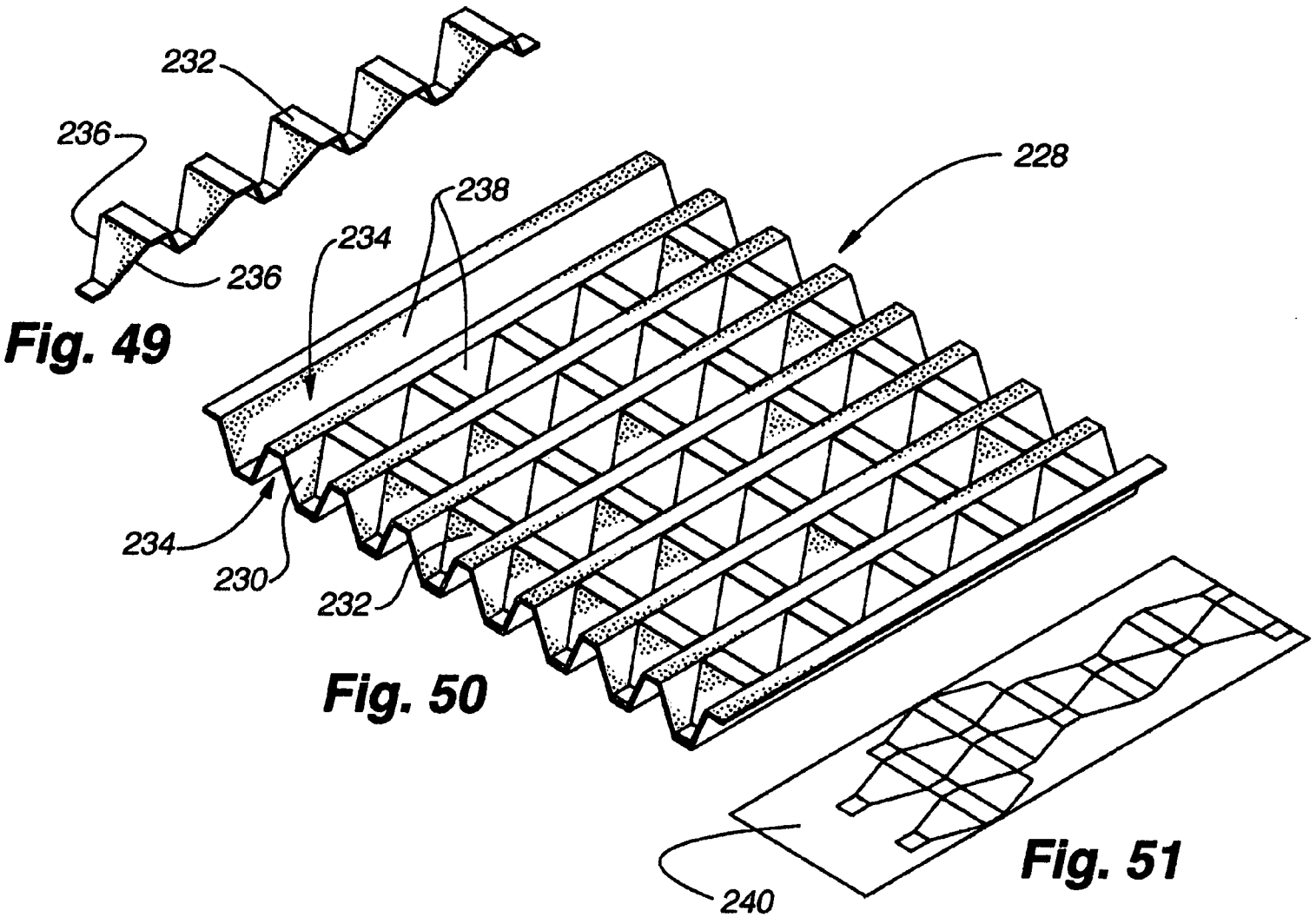
FIG. 49 is an isometric view of a secondary reinforcement strip used in the panel of FIG. 47.
FIG. 50 is an isometric view of the reinforcement structure for the panel shown in FIG. 47.
FIG. 51 is an isometric view of a sheet of material illustrating how the secondary reinforcement shown in FIG. 49 can be cut from such a sheet.
Figures 52, 53, 54:
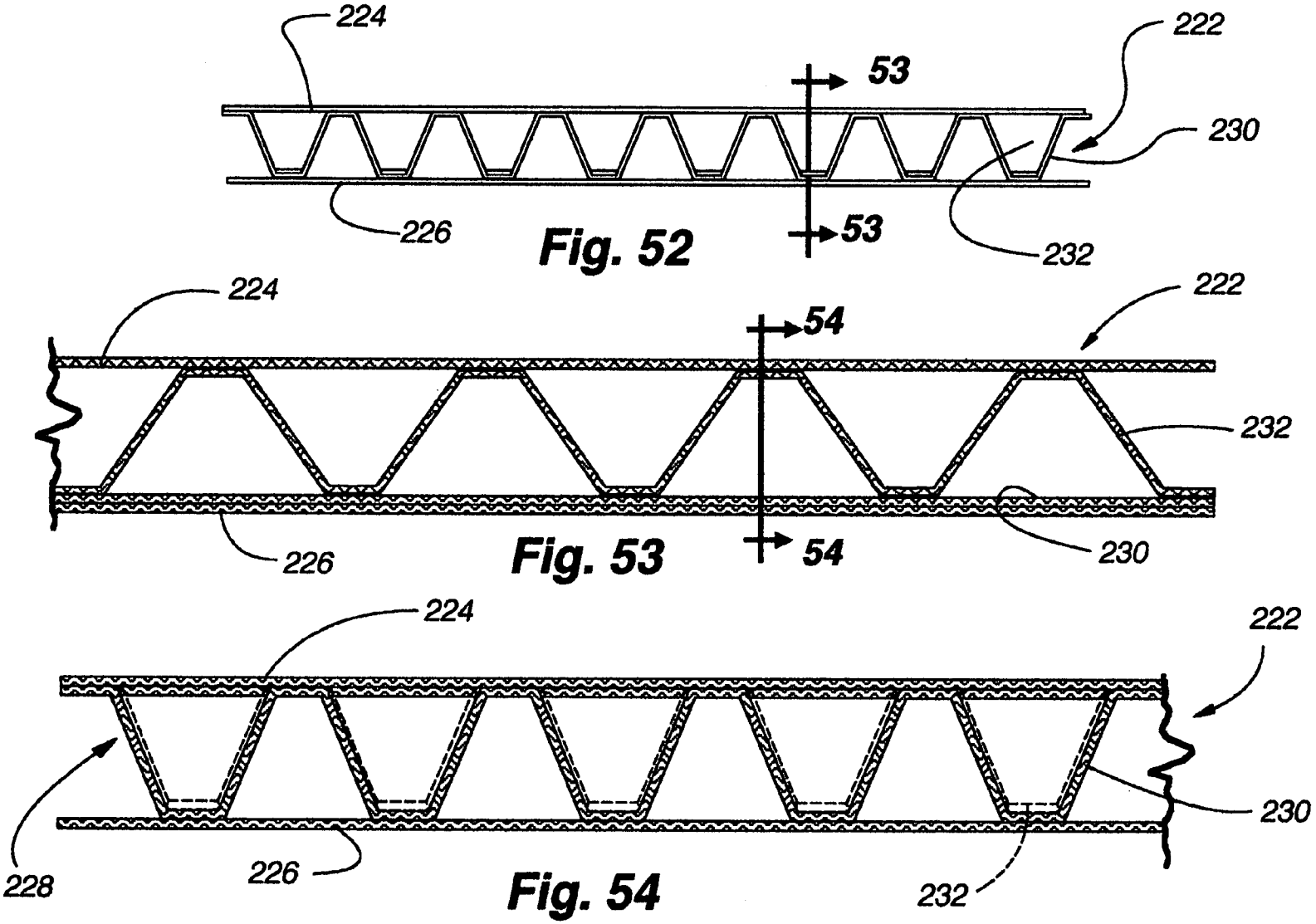
FIG. 52 is a side elevation of the panel shown in FIG. 47 looking upwardly and to the right from the lower lefthand side of the panel as shown in FIG. 47.
FIG. 53 is an enlarged section taken along line 53—53 of FIG. 52.
FIG. 54 is a section taken along line 54—54 of FIG. 53.

FIGS. 47–56 illustrate an eighth embodiment 222 of the present invention wherein a pair of parallel planar sheets 224 and 226 are interconnected by a reinforcement member 228 that includes a primary reinforcement portion 230 and secondary reinforcement portions 232 which provide rigidity in a transverse direction to the primary portion. As best illustrated in FIGS. 49 and 50, the primary reinforcement portion 230 is a furrowed member substantially the same as the primary reinforcement member of FIG. 39 thereby defining upwardly and downwardly opening channels 234 of trapezoidal cross-section. The secondary reinforcement portions 232 are insert strips, as illustrated in FIG. 49, that are adapted to be received in the upwardly opening channels of the primary reinforcement portion. Each secondary reinforcement strip has a cross-sectional configuration substantially identical to that of the primary portion, but the planar side walls 236 of the strip, which extend perpendicularly to the channels in the primary reinforcement portion, are tapered so as to converge downwardly thereby to conform with the downwardly convergent walls 238 of the upwardly opening channels of the primary portion of the reinforcement member. Accordingly, when the secondary reinforcement strips are positioned within the upwardly opening channels of the primary reinforcement portion, the reinforcement member is structured as illustrated in FIG. 50, and it will be appreciated that the panel has substantial rigidity in both longitudinal and transverse directions even though a slight degree of flexing is achievable due to the characteristics of the material from which the reinforcement member is made.

FIG. 51 illustrates a sheet of material 240 from which the secondary reinforcement portions can be cut and folded and as will be appreciated, a number of such strips 232 can be cut in a complimentary manner from the same sheet of material.

Figure 55:
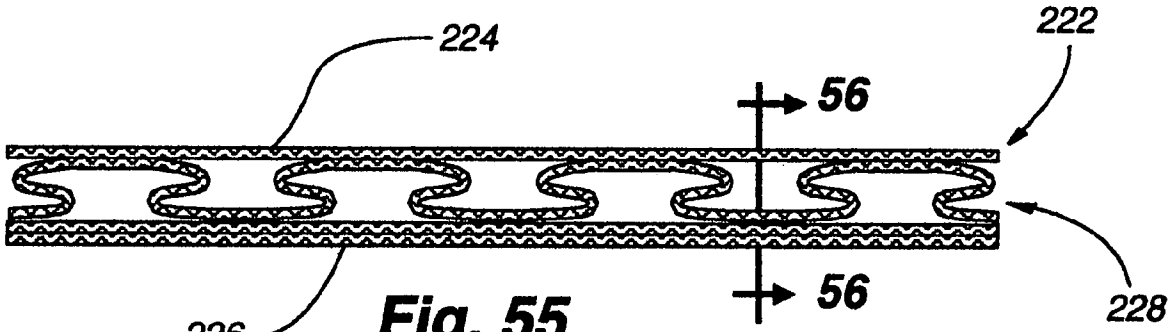
FIG. 55 is a section taken along line 55—55 of FIG. 56 and similar to FIG. 53 showing the panel partially compressed.
Figure 56:
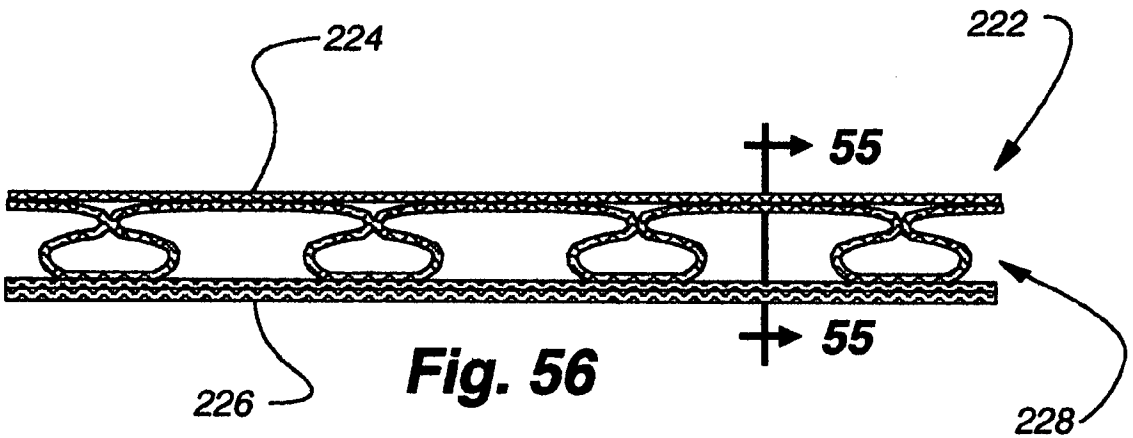
FIG. 56 is a section taken along line 56—56 of FIG. 55 and being similar to FIG. 54 with the panel partially compressed.

FIGS. 55 and 56 illustrate the compressible nature of the panel 222 which is permitted due to the flexible nature of the material from which the reinforcement member 228 is made and as will be appreciated, depending upon the amount of pressure applied to the planar sheet members 224 and 226, the reinforcement members will buckle into the contoured configuration illustrated allowing the panel to assume a thinner or shallower cross-section, again, for shipping purposes. In other words, the panels can be forcibly compressed into containers for shipment so as to occupy a minimal amount of space compared to that which would be occupied by the fully expanded panel.

Figure 57:
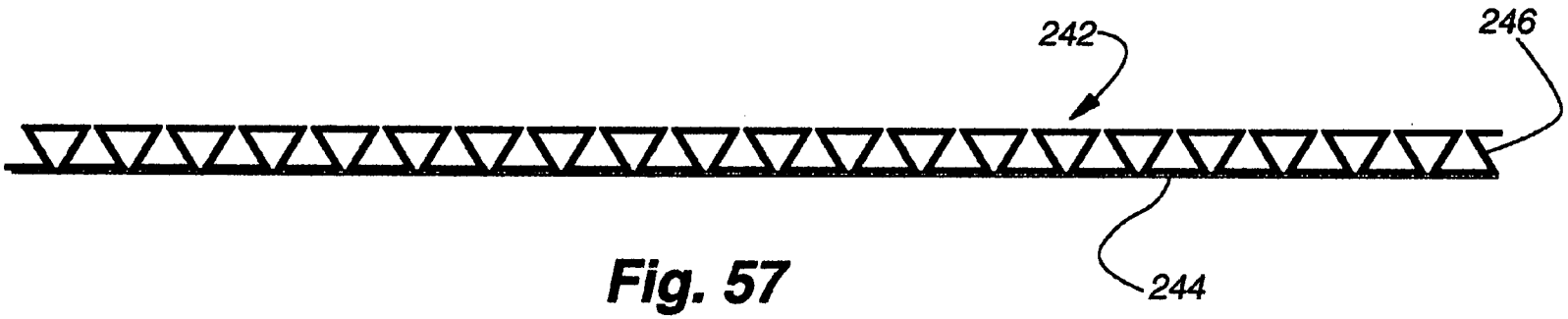
FIG. 57 is a side elevation of a ninth embodiment of a panel formed in accordance with the present invention.
Figure 58:
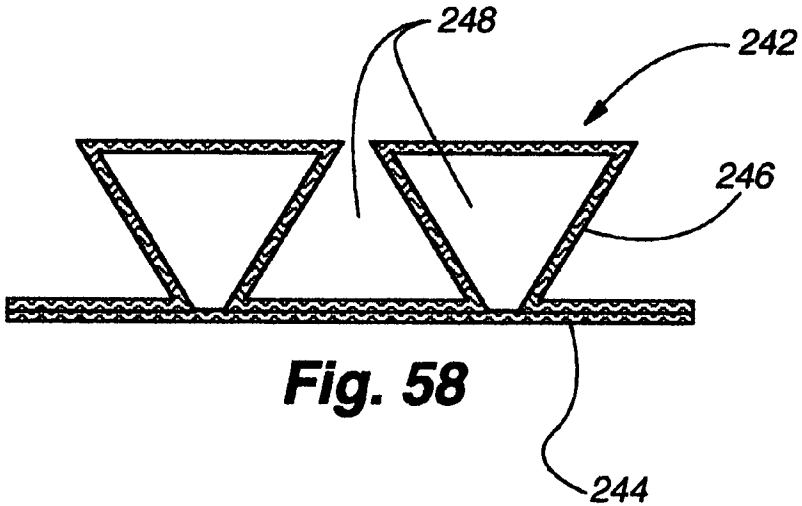
FIG. 58 is a fragmentary vertical section taken through a portion of the panel shown in FIG. 57.
Figure 59:
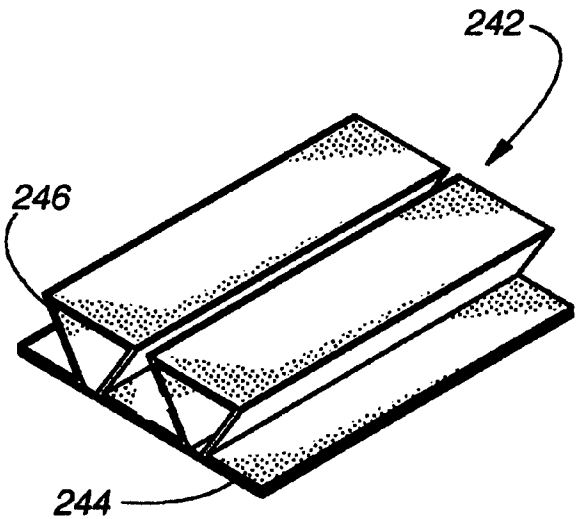
FIG. 59 is a fragmentary isometric of the portion of the panel illustrated in FIG. 58.

FIGS. 57–59 illustrate a ninth embodiment 242 of the panel of the present invention which includes a lower planar sheet of material 244 and a reinforcement member 246 bonded or otherwise secured to the upper surface thereof to permit easy flexing of the panel in a downward direction but the reinforcement member resists flexing of the panel in an upwardly direction and transverse directions. The reinforcement member has alternate upwardly and downwardly opening channels 248 of trapezoidal cross-sectional configuration but the opening of each channel is significantly narrower than the opposed closed side of the same channel. As will be appreciated, the panel would be allowed to flex readily in a downward direction but not so readily in an upward direction and not so readily in a transverse direction. The reinforcement member is secured to the planar sheet material along areas of engagement in any suitable manner which could include adhesive applied in lines, continuously across the areas of engagement, along intermittent lines or dots or the like.

Figure 60:
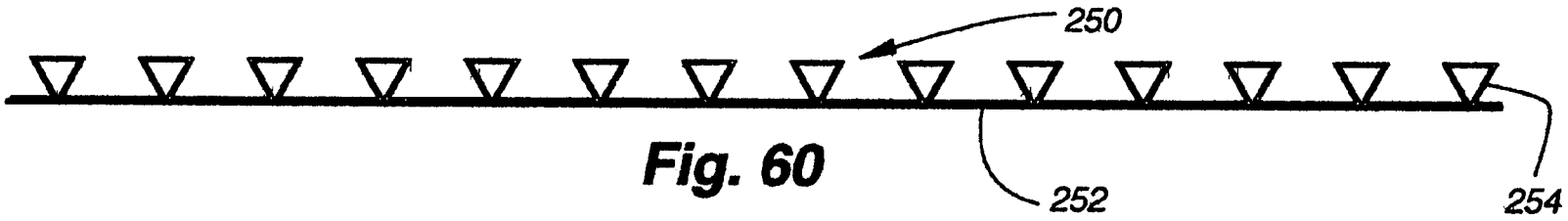
FIG. 60 is a side elevation of a tenth embodiment of a panel formed in accordance with the present invention.
Figure 61:
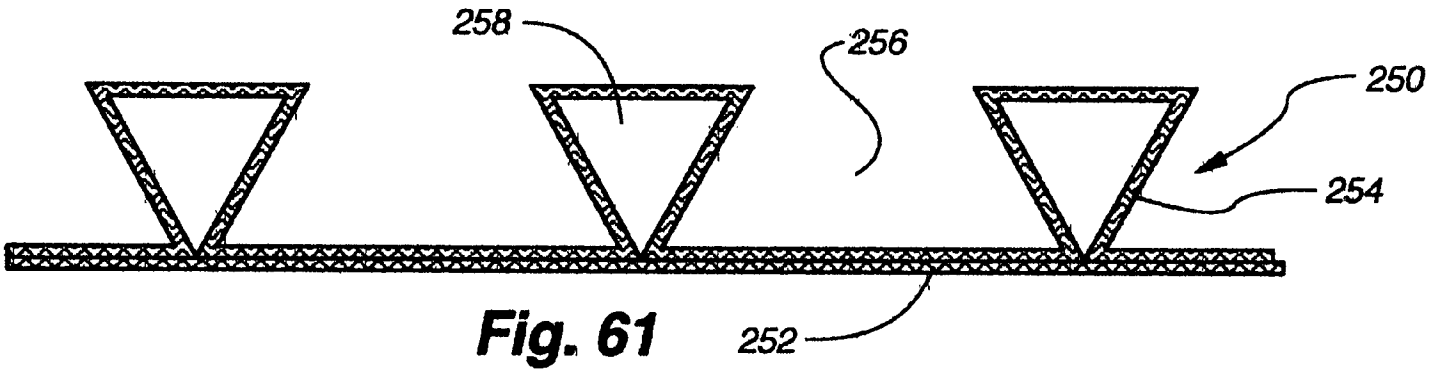
FIG. 61 is a fragmentary vertical section taken through the panel of FIG. 60.
Figure 62:
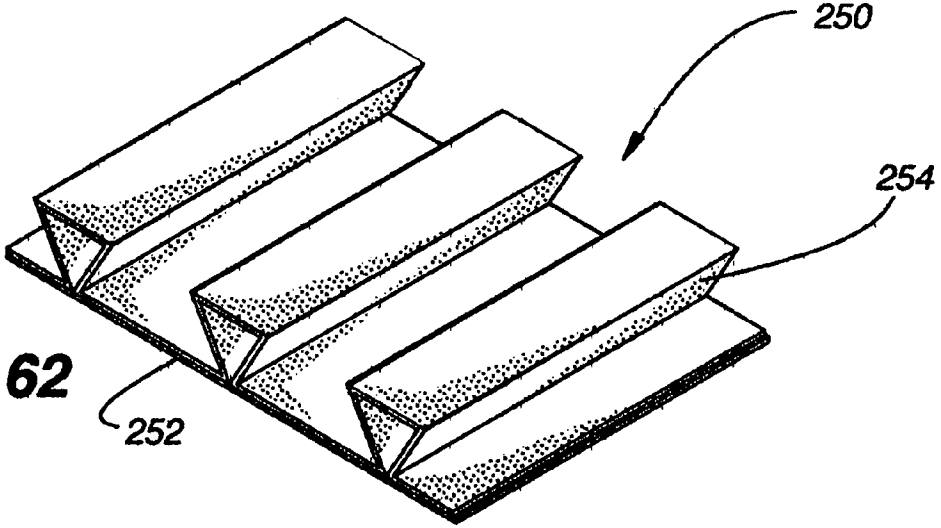
FIG. 62 is a fragmentary isometric showing the portion of the panel illustrated in FIG. 61.

A tenth embodiment 250 of a panel formed in accordance with the present invention is illustrated in FIGS. 60–62. In this embodiment, a planar sheet of material 252 is bonded or otherwise secured in a suitable manner to an overlying reinforcement member 254 that is similar to the reinforcement member shown in the embodiment illustrated in FIG. 58 but wherein the upwardly opening trapezoidal channels 256 of the reinforcement member are significantly wider than the downwardly opening channels 258. This arrangement would permit not only flexing in the downward direction but also more flexing in the upward direction than would be permitted by the embodiment shown in FIGS. 57–59. The lower exposed face of the sheet 252, which face is exposed to the interior of the room in which the ceiling system is mounted, can be modified by providing it with a continuous elastomeric polymer (not shown). Preferably, the elastomeric polymer is a thermoplastic or thermosetting polymeric film, such as a urethane or neoprene film, as described previously with reference to FIG. 14, or a urethane or neoprene adhesive that bonds a decorative film, as described above with reference to FIG. 14, on the lower face of the sheet 252. The elastomeric polymer allows the panel 250 to be substantially flexed or bent without visible creasing of the sheet 252. As a result, the panel 250 can be manufactured in long lengths which can be stored and shipped in rolled-up form and then unrolled and cut to length for installation.

Figure 63:
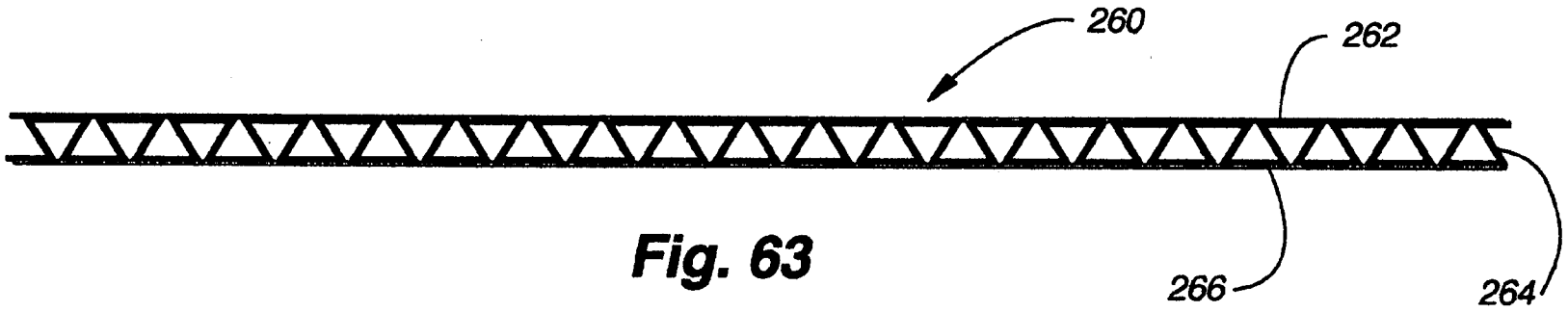
FIG. 63 is a side elevation of an eleventh embodiment of a panel formed in accordance with the present invention.
Figure 64:
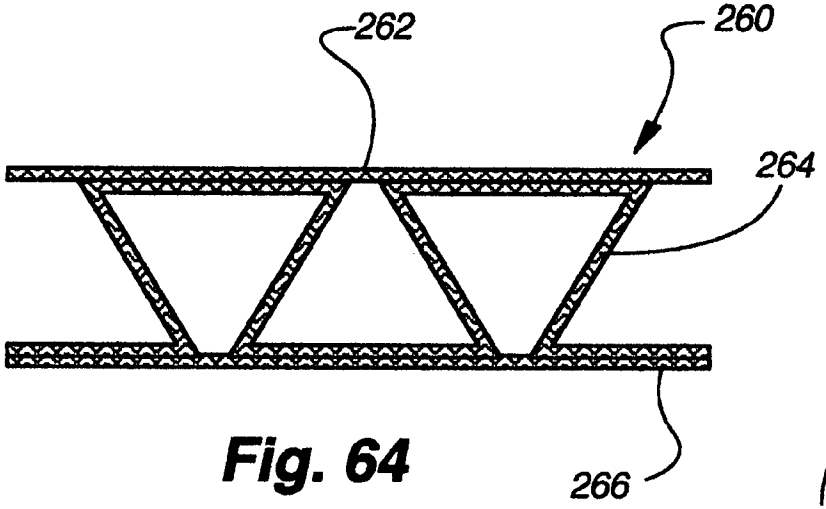
FIG. 64 is an enlarged fragmentary vertical section showing a portion of the panel of FIG. 63.
Figure 65:
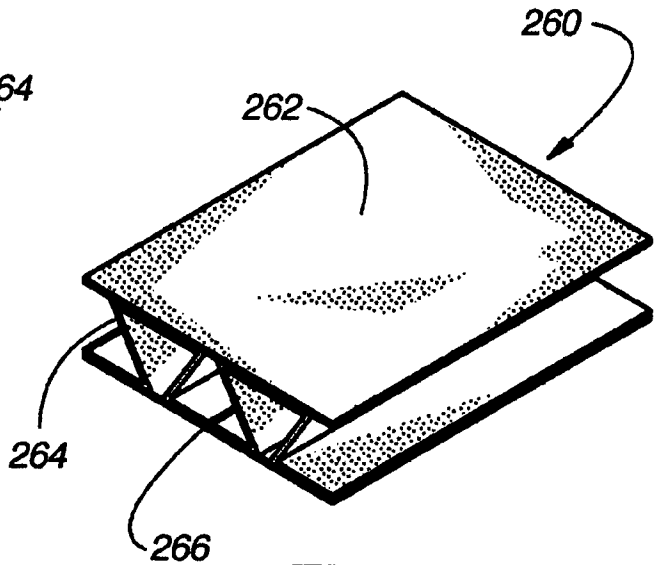
FIG. 65 is a fragmentary isometric showing the portion of the panel illustrated in FIG. 64.

An eleventh embodiment 260 of a panel in accordance with the present invention is illustrated in FIGS. 63–65. This embodiment is identical to that illustrated in FIGS. 57–59 except that an upper planar sheet of material 262 is secured to a reinforcement member 264 across the top of the reinforcement member in the same or similar manner to which a bottom sheet material 266 is secured to the lower surface of the reinforcement member. This panel would have similar behavioral characteristics to that of the panel illustrated in FIG. 58 but would have slightly more rigidity and better insulating qualities.

Figure 66:
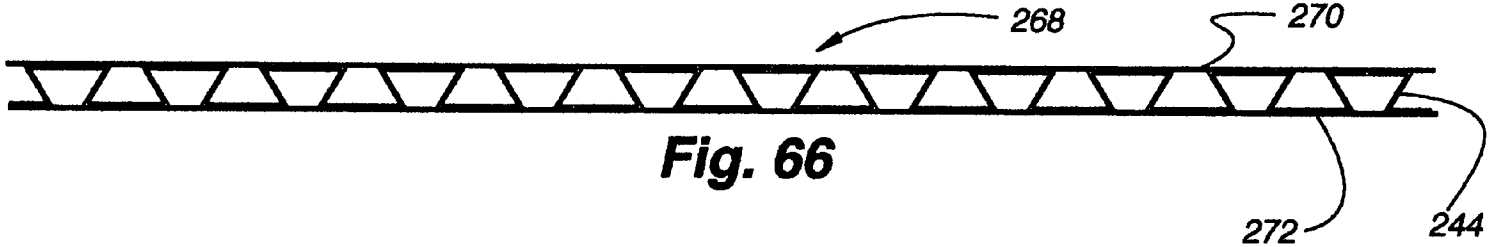
FIG. 66 is a side elevation of a twelfth embodiment of a panel formed in accordance with the present invention.
Figure 67:
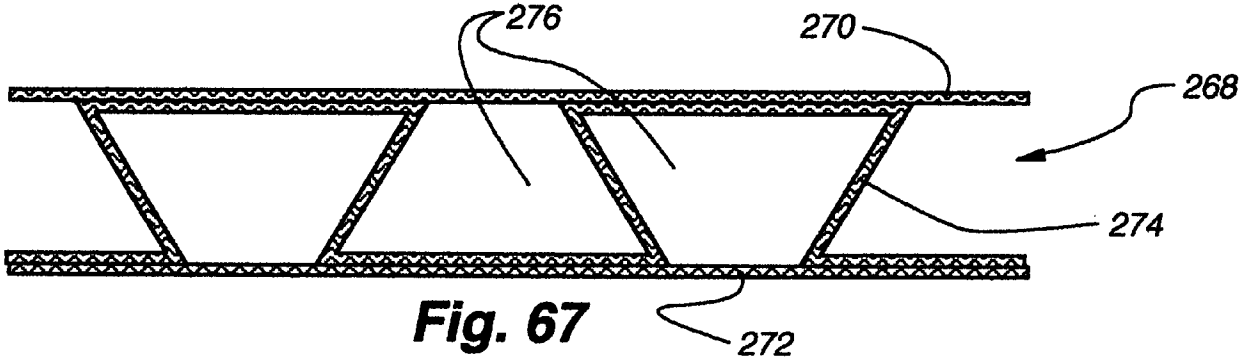
FIG. 67 is an enlarged vertical section taken through a portion of the panel shown in FIG. 66.
Figure 68:
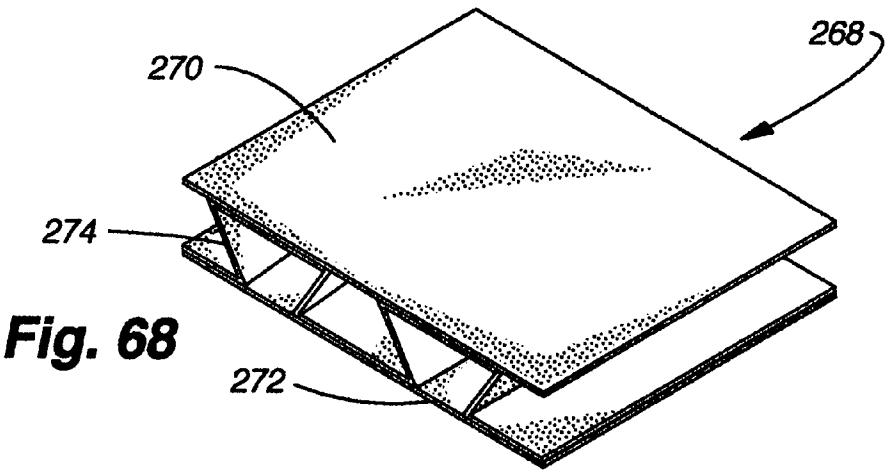
FIG. 68 is a fragmentary isometric view illustrating the portion of the panel shown in FIG. 67.

FIGS. 66–68 illustrate a twelfth embodiment 268 of a panel formed in accordance with the present invention, with this embodiment including upper and lower planar sheets of material 270 and 272, respectively, that are secured to and separated by a reinforcement member 274 having upwardly and downwardly opening channels 276 of transverse trapezoidal configuration. The reinforcement member is similar to that of FIG. 58 except that the trapezoidal cross-section is slightly enlarged so that the opening of the trapezoidal channels in both the upward and downward directions is slightly greater than that of the reinforcement member of FIG. 58.

Figure 69:
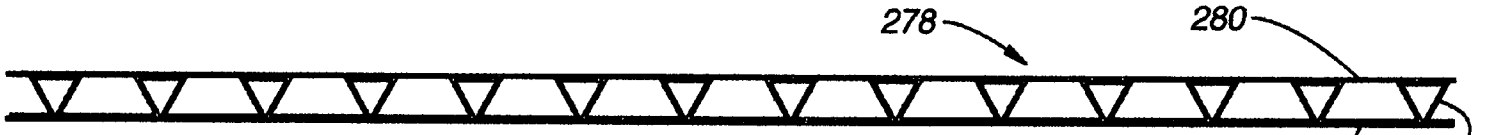
FIG. 69 is a side elevation of a thirteenth embodiment of a panel formed in accordance with the present invention.
Figure 70:
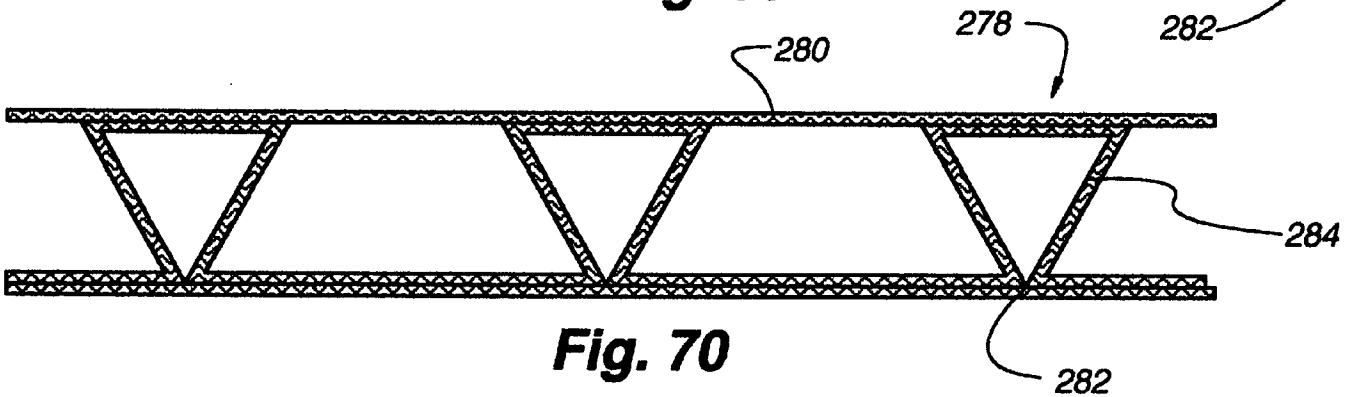
FIG. 70 is an enlarged vertical section taken through a portion of the panel shown in FIG. 69.
Figure 71:
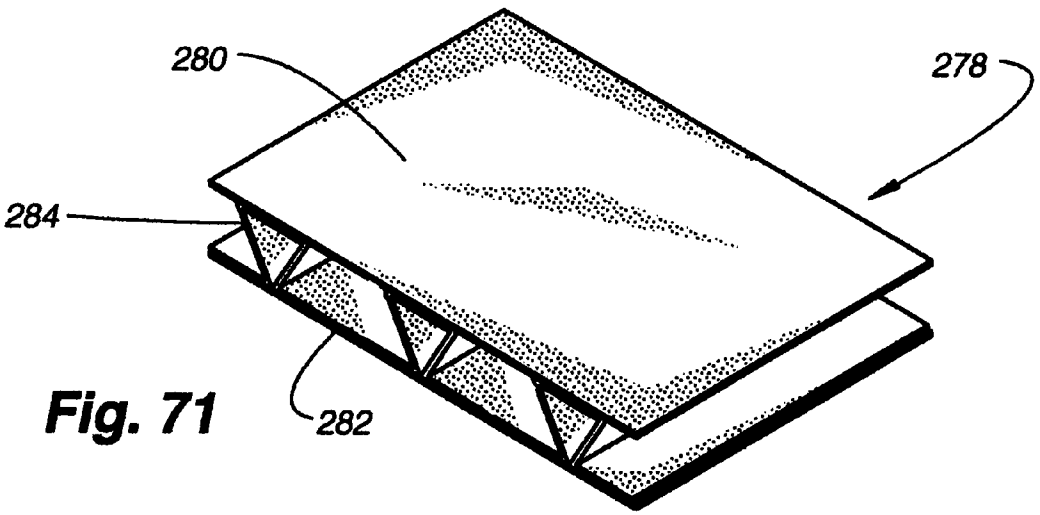
FIG. 71 is a fragmentary isometric illustrating the portion of the panel shown in FIG. 70.
Figure 72:
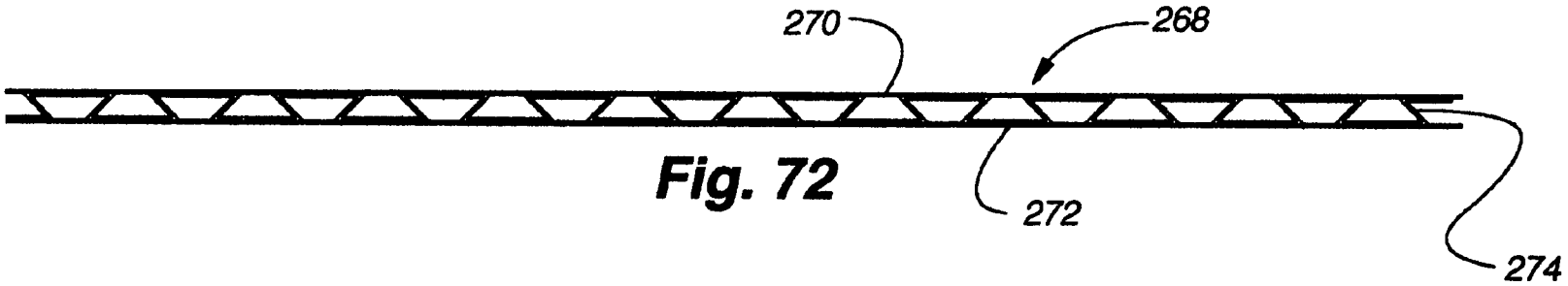
FIG. 72 is a side elevation of a fourteenth embodiment of a panel formed in accordance with the present invention.

A thirteenth embodiment 278 of a panel formed in accordance with the present invention is illustrated in FIGS. 69–71, with this panel, including upper and lower planar sheet materials 280 and 282, respectively, that are interconnected by and spaced by a reinforcement member 284. The reinforcement member is substantially identical to that illustrated in the embodiment of FIGS. 60 and 61.

Figure 73:
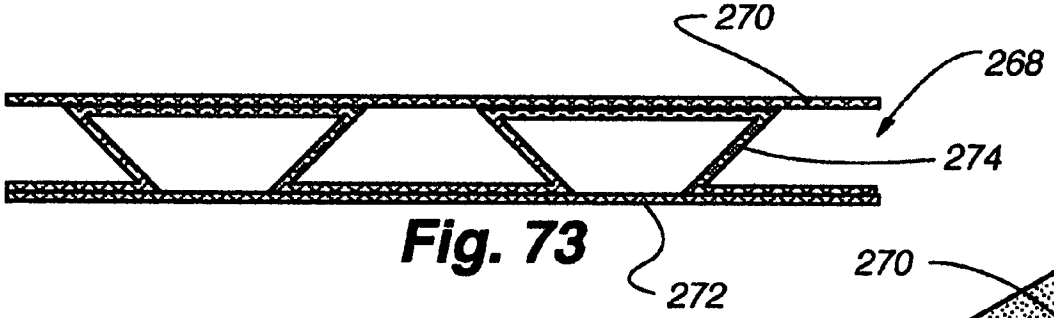
FIG. 73 is an enlarged vertical section taken through a portion of the panel shown in FIG. 72.
Figure 75:
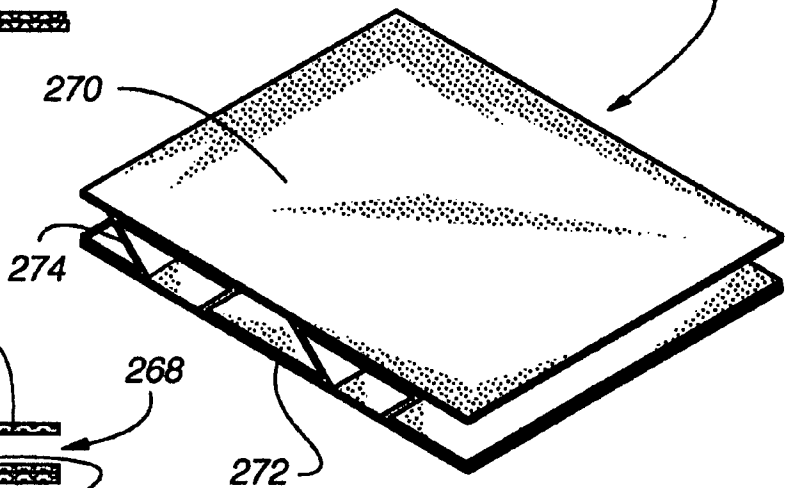
FIG. 75 is a fragmentary isometric of the portion of the panel shown in FIGS. 73 and 74.
Figure 74:
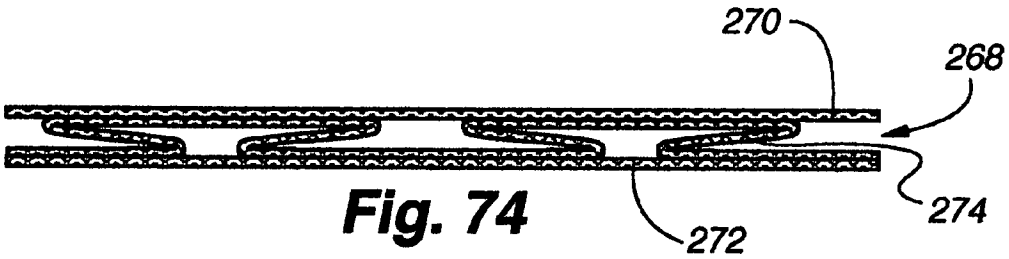
FIG. 74 is a vertical section similar to FIG. 73 showing the panel partially compressed.
Figure 76:
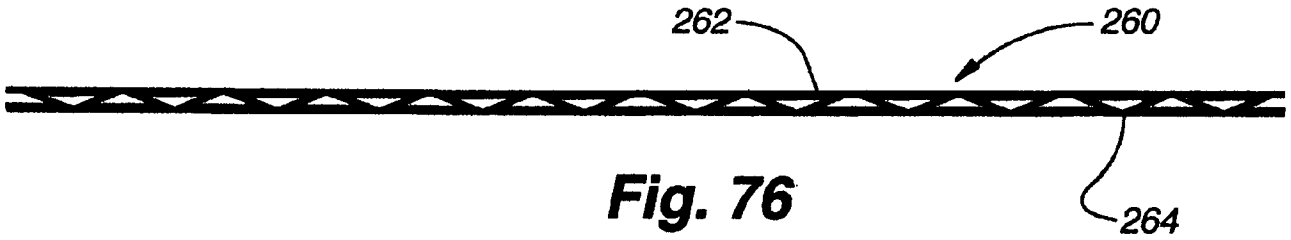
FIG. 76 is a side elevation of a fifteenth embodiment of a panel formed in accordance with the present invention.
Figure 79:
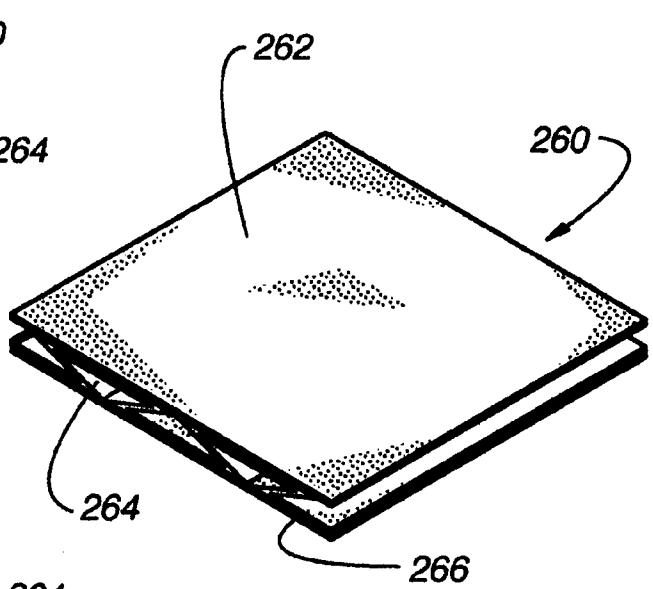
FIG. 79 is a fragmentary isometric of the portion of the panel shown in FIGS. 77 and 78.

FIGS. 72–75 illustrate the compressibility of the panel 268 described previously in connection with FIGS. 66–68 and wherein it will be appreciated in FIG. 73 that the panel can be compressed a slight amount without buckling the resilient walls of the reinforcement member 274, but additional compression allows the walls of the reinforcement member to further fold relative to each other into the configuration illustrated in FIG. 74. The walls will actually buckle so that the panel can be substantially compressed for cost savings during shipment.

Figure 77:
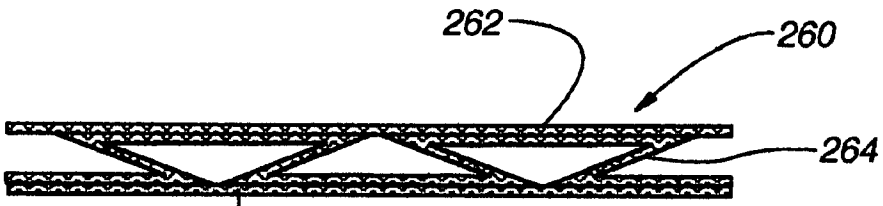
FIG. 77 is an enlarged vertical section taken through a portion of the panel shown in FIG. 76.
Figure 78:
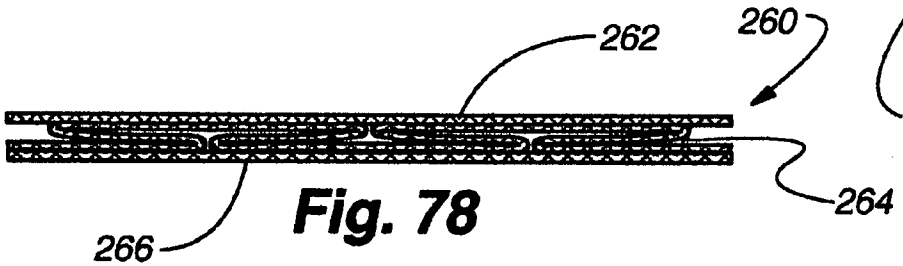
FIG. 78 is a vertical section similar to FIG. 77 showing the panel partially compressed.

FIGS. 76–79 illustrate the compressibility of the panel 260 described previously in connection with FIGS. 63–65 wherein it will again be appreciated that a slight amount of compression, as seen in FIG. 77, is possible without buckling the resilient walls of the reinforcement member 264 but additional compression of the panel causes the walls to buckle and fold, as illustrated in FIG. 78, so that the panel is substantially thinner thereby occupying less space within a shipping container.

Figure 80:
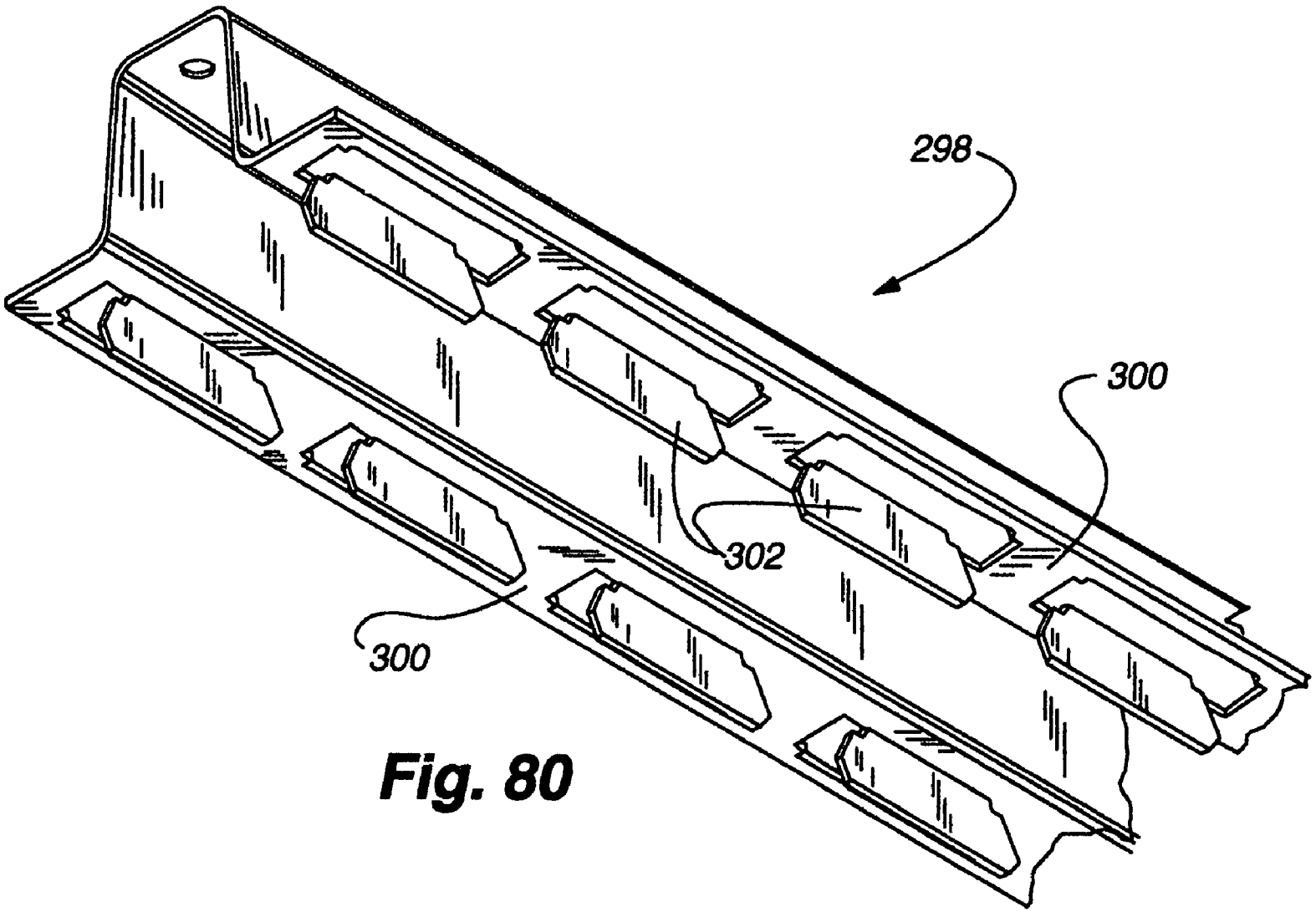
FIG. 80 is a fragmentary isometric view of a support member adapted for use in connection with the panel shown in FIG. 60.
Figure 81:
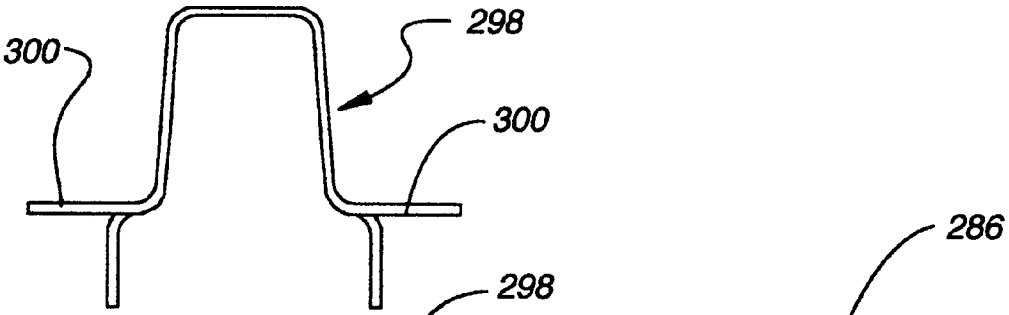
FIG. 81 is an end elevation of the support member shown in FIG. 80.

FIGS. 80–83 illustrate a sixteenth embodiment 286 of a panel formed in accordance with the present invention. This panel is very similar to the panel described previously in FIGS. 60–62 in that it includes a lower planar sheet of material 288 and a reinforcing member 290 with upwardly opening trapezoidal channels 292 spaced by closed triangular shaped channels 294. As will be appreciated, the upwardly opening channels that are of trapezoidal cross-sectional configuration define a space 296 along the upper surface of the reinforcement member between the triangular channels 294. A support member 298, which is best seen in FIG. 80, is positioned across the top of the reinforcement member and extends perpendicularly to the channels in the reinforcement member so as to provide rigidity to the panel in a direction transverse to that provided by the reinforcement member so that the panel is rigidified in perpendicular directions.

Figure 82:
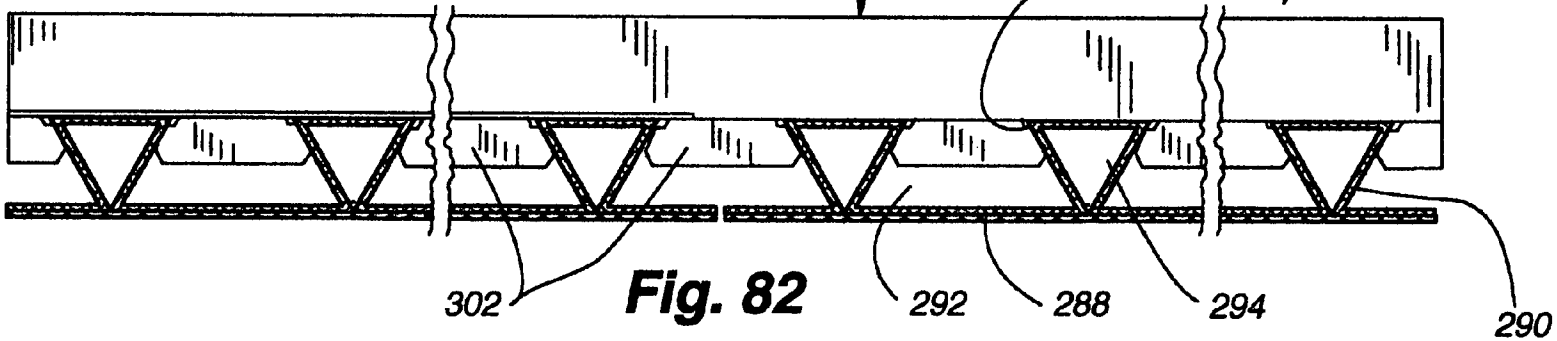
FIG. 82 is an end elevation of the support member incorporated into the panel of FIG. 60.
Figure 83:
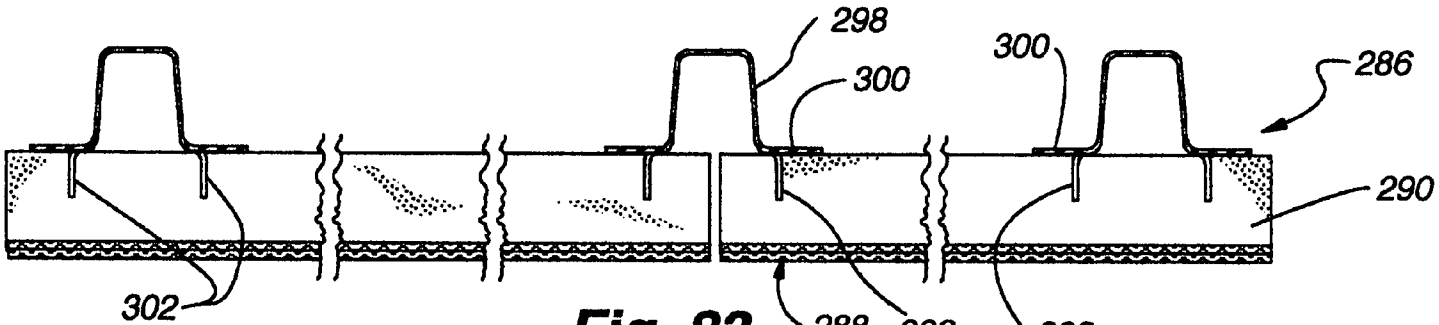
FIG. 83 is a side elevation of the panel of FIG. 60 with the support member of FIG. 80 incorporated therein.

The support member 298, which can be made of the same material as the planar sheet 288 and the reinforcement member 284 and as seen in FIG. 80, includes a downwardly opening channel-shaped body of inverted U-shaped cross-section projecting away from the reinforcement member and having outwardly directed flanges 300 from which a plurality of tabs 302 are cut and bent to extend downwardly. The cross-section of the tabs 302 is best seen in FIG. 82 to conform generally to the walls and space 296 of the trapezoidal channels in the reinforcement member so as to mechanically connect the support member to the reinforcement member. The support member can, therefore, be mounted on the reinforcement member by positioning the support member perpendicular to the trapezoidal channels and sliding the support member along the length of the channels until it is desirably positioned. A plurality of the downwardly opening support members can be positioned at any desired spacing, as illustrated in FIG. 83. The support members, accordingly, substantially rigidify the panel so that it has very little flexibility in any perpendicular direction.

To the extent it is not clear from the above, the connection between the various components of the panels described can be achieved adhesively, ultrasonically, through heat fusion or any other acceptable bonding system. The connections are made where a component engages an upper or lower sheet of the panel or along peaks defined by a component of the panel.

It will be appreciated from the above that an improved panel for use in a drop ceiling system or in other similar uses has been provided that has variable features for adjusting the flexibility of the panel in longitudinal or transverse directions and also for varying the compressibility of the panel for shipping purposes. The exposed faces of the panels of this invention can also be modified by adding a continuous elastomeric polymer, such as a urethane or neoprene film or adhesive, as described, by way of example, with regard to the panels of FIGS. 13 and 60–62 and/or a decorative film as described, by way of example, with regard to the panel of FIG. 13. Due to the flexible nature of the panels, they can also be easily inserted into the openings defined by the stringers and cross-members of a suspended support system and the panels will not break, as they are not brittle even when being flexed for insertion into the support system. With modifications to the suspension system, it will also be appreciated that the panels could be used in a wall of a building structure.

It will further be appreciated from the above that a panel for use in a drop ceiling system or in other similar uses and as described would provide ideal and variable acoustical properties and insulation. The variance in the number of layers provided in the panel in the form of upper and lower sheets, dividers, reenforced members and the like, define a plurality of air pockets with the number of layers and pockets varying depending upon the embodiment of the panel employed. Further, the lower panel or a decorative sheet applied thereto can be made of sound reflective material or sound absorbing material to further provide variability to the acoustics of the panel.

Although the present invention has been described with a certain degree of particularity, it is understood that the present disclosure has been made by way of example, and changes in detail or structure may be made without departing from the spirit of the invention as defined in the appended claims.

What is claimed is:

1. A flexible and resilient ceiling panel that can be folded and flexed as an entire panel and return to its original configuration while being inserted into an opening in a supporting grid work of a ceiling of a building structure, comprising:

at least one first sheet; and at least one second sheet formed into a first reinforcement layer that is a three-dimensional body, said at least one second sheet having a plurality of elongated channels; and wherein said elongated channels are positioned to confront said first sheet; and wherein said first sheet and said first reinforcement layer are each of a somewhat rigid material that can be flexed and that comprises heat-resistant fibers bound together by a resin.

2. The panel of claim 1 wherein said reinforcement layer is a furrowed sheet defining oppositely directed elongated channels at least some of which are confronting with said first sheet so as to define elongated cells between said reinforcement layer and said first sheet.

3. The panel of claim 2 wherein at least some of said channels are of trapezoidal transverse cross-section.

4. The panel of claim 2 wherein at least some of said channels are of triangular transverse cross-section.

5. The panel of claim 2, 3 or 4 wherein said reinforcement layer is secured to said first sheet.

6. The panel of claim 2, 3 or 4 wherein said reinforcement layer is adhesively bonded to said first sheet.

7. The panel of claim 2, 3 or 4 wherein said reinforcement layer is heat welded to said first sheet.

8. The panel of claim 2, 3 or 4 wherein said reinforcement layer is ultrasonically bonded to said first sheet.

9. The panel of claim 2 further including a secondary reinforcement layer that is a furrowed sheet defining oppositely directed elongated channels, the channels of said secondary reinforcement layer being less deep than the channels in the first mentioned reinforcement layer and wherein said secondary reinforcement layer is overlaid across said first mentioned reinforcement layer such that at least some of said channels in said secondary reinforcement layer are positioned within channels of said first mentioned reinforcement layer.

10. The panel of claim 9 wherein said secondary reinforcement layer is secured to said first mentioned reinforcement layer.

11. The panel of claim 9 wherein there are a pair of furrowed secondary reinforcement layers with one overlaid and one underlaid across said first mentioned reinforcement layer.

12. The panel of claim 11 wherein each of said secondary reinforcement layers is secured to said first mentioned reinforcement layer.

13. The panel of claim 2 further including a secondary reinforcement portion having planar surfaces extending perpendicularly to said channels in said reinforcement layer.

14. The panel of claim 13 wherein said secondary reinforcement portion is of elongated furrowed construction and adapted to be received in one of said channels in said first mentioned reinforcement layer.

15. The panel of claim 14 wherein there are a plurality of said secondary reinforcement portions with each secondary reinforcement portion received in a separate channel of said first mentioned reinforcement layer.

16. The panel of claim 2, 9, 11, 13 or 15 further including a decorative layer of material secured to said first sheet of material with said reinforcement layer secured to one face of said first sheet of material and said decorative layer secured to an opposite face of said first sheet of material.

17. The panel of claim 16 wherein said decorative layer is an elastomeric polymer.

18. The panel of claim 17 wherein said elastomeric polymer is a thermoplastic or thermosetting polymeric film.

19. The panel of claim 2 wherein the material from which said reinforcement layer is made is creasable and the material from which said first sheet is made is creasable.

20. The panel of claim 2, 9, 11, 13 or 14 wherein there are two of said first sheets defining substantially flat substrate materials and said reinforcement layer is positioned therebetween.

21. The panel of claim 20 wherein said two of said first sheets are secured to said reinforcement layer.

22. The panel of claim 21 wherein said reinforcement layer is compressible allowing the panel to be compressed by moving one of said first sheets perpendicularly toward the other of said first sheets.

23. The panel of claim 20 wherein said reinforcement layer is compressible allowing the panel to be compressed by moving one of said first sheets perpendicularly toward the other of said first sheets.

24. The panel of claim 20 wherein said reinforcement layer is collapsible allowing the panel to be compressed by moving said first sheets toward each other while shifting one of said first sheets relative to the other of said first sheets in a lateral direction.

25. The panel of claim 2 or 4 further including at least one support member operatively connected to said reinforcement layer on an opposite side thereof from said first sheet of material, said support member being elongated and extending perpendicularly to said elongated channels.

26. The panel of claim 25 wherein said at least one support member is mechanically connected to said reinforcement layer.

27. The panel of claim 26 wherein said at least one support member includes tabs adapted to be received in channels of said reinforcement layer to mechanically connect said at least one support member to said reinforcement layer.

28. The panel of claim 27 wherein said support member further includes an inverted U-shaped body projecting away from said reinforcement layer.

29. The panel of claim 28 wherein said at least one support member further includes flanges adapted to abut said reinforcement layer.

30. The panel of claim 26 wherein said at least one support member and said reinforcement layer are made of the same material.

31. The panel of claim 25 wherein said at least one support member and said reinforcement layer are made of the same material.

32. The panel of claim 25 wherein there are a plurality of said support members.

33. A flexible ceiling panel for incorporation into a building structure comprising at least one sheet of a substantially flat substrate material and a reinforcement layer secured to said substrate material, said reinforcement layer including at least one sheet of material having a plurality of channels formed therein, said panel being formed into a three-dimensional, self-supporting, resilient body having a plurality of elongated cells, said body being flexible and foldable as an entire body while retaining its resiliency to return to a substantially flat state after having been flexed as an entire body and wherein at least one sheet of substrate material is made of a fibrous material.

34. The panel of claim 33 wherein said elongated cells are formed between said at least one sheet of substrate material and said reinforcement layer being made from at least one separate piece of material than said at least one sheet of substrate material.

35. The panel of claim 34 wherein said reinforcement layer is a furrowed sheet defining oppositely directed elongated channels at least some of which are confronting with said at least one sheet of substrate material so as to define said elongated cells between said reinforcement member and said at least one sheet of substrate material.

36. The panel of claim 35 wherein at least some of said channels are of trapezoidal transverse cross-section.

37. The panel of claim 35 wherein at least some of said channels are of triangular transverse cross-section.

38. The panel of claim 35 further including a secondary reinforcement layer that is a furrowed sheet defining oppositely directed elongated channels, the channels of said secondary reinforcement layer being less deep than the channels in the first mentioned reinforcement layer and wherein said secondary reinforcement layer is overlaid across said first mentioned reinforcement layer such that at least some of said channels in said secondary reinforcement layer are positioned within channels of said first mentioned reinforcement layer.

39. The panel of claim 38 wherein said secondary reinforcement layer is secured to said first mentioned reinforcement layer.

40. The panel of claim 38 wherein there are a pair of corrugated secondary reinforcement layers with one overlaid and one underlaid across said first mentioned reinforcement layer.

41. The panel of claim 40 wherein each of said secondary reinforcement layers is secured to said first mentioned reinforcement layer.

42. The panel of claim 35 further including a secondary reinforcement portion having planar surfaces extending perpendicularly to said channels in said reinforcement layer.

43. The panel of claim 42 wherein said secondary reinforcement portion is of elongated furrowed construction and adapted to be received in one of said channels in said first mentioned reinforcement layer.

44. The panel of claim 43 wherein there are a plurality of said secondary reinforcement portions with each secondary reinforcement portion received in a separate channel of said first mentioned reinforcement layer.

45. The panel of claim 35 or 37 further including at least one support member operatively connected to said reinforcement layer on an opposite side thereof from said at least one sheet of substrate material, said support member being elongated and extending perpendicularly to said elongated channels.

46. The panel of claim 45 wherein said at least one support member is mechanically connected to said reinforcement layer.

47. The panel of claim 46 wherein said at least one support member includes tabs adapted to be received in channels of said reinforcement layer to mechanically connect said at least one support member to said reinforcement layer.

48. The panel of claim 47 wherein said support member further includes an inverted U-shaped body projecting away from said reinforcement layer.

49. The panel of claim 48 wherein said at least one support member further includes flanges adapted to abut said reinforcement layer.

50. The panel of claim 46 wherein said at least one support member and said reinforcement layer are made of the same material.

51. The panel of claim 45 wherein said at least one support member and said reinforcement layer are made of the same material.

52. The panel of claim 45 wherein there are a plurality of said support members.

53. The panel of claim 34, 35, 36 or 37 wherein said reinforcement layer is secured to said at least one sheet of substrate material.

54. The panel of claim 34, 35, 36 or 37 wherein said reinforcement layer is adhesively bonded to said at least one sheet of substrate material.

55. The panel of claim 34, 35, 36 or 37 wherein said reinforcement layer is heat welded to said at least one sheet of substrate material.

56. The panel of claim 34, 35, 36 or 37 wherein said reinforcement layer is ultrasonically bonded to said at least one sheet of substrate material.

57. The panel of claims 34, 35, 39, 40, 42 or 43 wherein there are two sheets of a substantially flat substrate material and said reinforcement layer is positioned therebetween.

58. The panel of claim 57 wherein said two sheets of substrate material are secured to said reinforcement layer.

59. The panel of claim 58 wherein said reinforcement layer is compressible allowing the panel to be compressed by moving one of said sheets perpendicularly toward the other of said sheets.

60. The panel of claim 57 wherein said reinforcement layer is compressible allowing the panel to be compressed by moving one of said first sheets perpendicularly toward the other of said first sheets.

61. The panel of claim 57 wherein said reinforcement layer is collapsible allowing the panel to be compressed by moving said first sheets toward each other while shifting one of said first sheets relative to the other of said first sheets in a lateral direction.

62. The panel of claim 33 wherein said fibrous material includes fibers of glass embedded in a resin.

63. The panel of claim 33, 34, 35, 38, 40, 42 or 44 further including a decorative layer of material secured to said at least one sheet of substrate material with said reinforcement layer secured to one face of said at least one sheet of substrate material and said decorative layer secured to an opposite face of said at least one sheet of substrate material.

64. The panel of claim 63 wherein said decorative layer is an elastomeric polymer.

65. The panel of claim 64 wherein said elastomeric polymer is a thermoplastic or thermosetting polymeric film.

66. The panel of claim 33, 34 or 35 wherein the material from which said reinforcement layer is made is creasable and the material from which said at least one sheet of substrate material is made is creasable.

67. The panel of claim 33 wherein there are two sheets of a substantially flat substrate material and said elongated reinforcement layer is secured to each of said sheets of substrate material so as to define a plurality of elongated cells between said sheets of substrate material and said reinforcement layer.

68. A flexible and resilient ceiling panel that can be folded and flexed as an entire panel and return to its original configuration while being inserted into an opening in a supporting grid work for a ceiling or a building structure, comprising:

at least one first sheet; and at least one second sheet formed into a first reinforcement layer that is a three-dimensional body, said at least one second sheet having an elongated channel; and wherein said elongated channel is positioned to confront said first sheet; and wherein said first sheet and said second sheet are each of a somewhat rigid material that can be flexed and that comprises heat-resistant fibers bound together by a resin, said second sheet having been creased and folded without damaging the fibers therein.

69. A resilient ceiling panel for incorporation into a building structure comprising at least one sheet of a substantially flat substrate material and a reinforcement layer made from at least one sheet of material having a plurality of channels formed thereon, said panel being formed into a three-dimensional, self-supporting, fully-compressible body having a plurality of elongated cells when in a normal at-rest position, said cells being fully compressed when the panel is fully compressed, said elongated cells being formed between said at least one sheet of substrate material and said reinforcement layer, said reinforcement layer being made from at least one separate piece of material than said at least one sheet of substrate material and wherein said at least one sheet of substrate material is made from a fibrous material.

70. The panel of claim 69 wherein said fibrous material includes fibers of glass embedded in a resin.

71. The panel of claim 70 wherein said reinforcement layer includes fibers of glass embedded in a resin.

72. A resilient ceiling panel for incorporation into a building structure comprising at least one sheet of a substantially flat substrate material and a reinforcement layer made from at least one sheet of material having a plurality of channels formed thereon, said panel being formed into a three-dimensional, self-supporting, fully-compressible body having a plurality of elongated cells when in a normal at-rest position, said cells being fully compressed when the panel is fully compressed, said elongated cells being formed between said at least one sheet of substrate material and said reinforcement layer, said reinforcement layer being made from at least one separate piece of material than said at least one sheet of substrate material, said reinforcement layer being a furrowed sheet defining oppositely directed elongated channels at least some of which are confronting with said at least one sheet of substrate material so as to define said elongated cells between said reinforcement layer and said at least one sheet of substrate material, said furrowed sheet being folded into a substantially flat configuration when said panel is fully compressed.

73. The panel of claim 72 wherein at least some of said channels are of trapezoidal transverse cross-section.

74. The panel of claim 69, 72, or 73 wherein said reinforcement layer is secured to said at least one sheet of substrate material.

75. The panel of claim 69, 72, or 73 wherein said reinforcement layer is adhesively bonded to said at least one sheet of substrate material.

76. The panel of claim 69, 72, or 73 wherein said reinforcement layer is heat welded to said at least one sheet of substrate material.

77. The panel of claim 69, 72, or 73 wherein said reinforcement layer is ultrasonically bonded to said at least one sheet of substrate material.

78. The panel of claim 72 further including at least one support member operatively connected to said reinforcement layer on an opposite side thereof from said at least one sheet of substrate material, said support member being elongated and extending perpendicularly to said elongated channels.

79. The panel of claim 78 wherein at least one support member is mechanically connected to said reinforcement layer.

80. The panel of claim 79 wherein said at least one support member and said reinforcement layer are made of the same material.

81. The panel of claim 78 wherein said at least one support member and said reinforcement layer are made of the same material.

82. The panel of claim 78 wherein there are a plurality of said support members.

83. The panel of claim 69 or 72 further including a decorative layer of material secured to said at least one sheet of substrate material with said reinforcement layer secured to one face of said at least one sheet of substrate material and said decorative layer secured to an opposite face of said at least one sheet of substrate material.

84. The panel of claim 83 wherein said decorative layer is an elastomeric polymer.

85. The panel of claim 84 wherein said elastomeric polymer is a thermoplastic or thermosetting polymeric film.

86. The panel of claim 69 or 72 wherein the material from which said reinforcement layer is made is creasable and the material from which said at least one sheet of substrate material is made is creasable.

87. The panel of claim 69 or 72 wherein there are two sheets of a substantially flat substrate material and said reinforcement layer is positioned therebetween.

88. The panel of claim 87 wherein said two sheets of substrate material are secured to said reinforcement layer.

89. A resilient ceiling panel for incorporation into a building structure comprising at least one sheet of a substantially flat substrate material and a reinforcement layer made from at least one sheet of material having a plurality of channels formed therein, said panel being formed into a three-dimensional, self-supporting, fully-collapsible body having a plurality of elongated cells when in a normal at-rest position, said cells being fully collapsed when the panel is fully collapsed, said elongated cells being formed between said at least one sheet of substrate material and said reinforcement layer, said reinforcement layer being made from at least one separate piece of material and said at least one sheet of substrate material, and wherein said at least one sheet of substrate material is made of a fibrous material.

90. The panel of claim 89 wherein said fibrous material includes fibers of glass embedded in a resin.

91. The panel of claim 90 wherein said reinforcement layer includes fibers of glass embedded in a resin.

* * * * *